US006325479B1

(12) United States Patent
Nakamura et al.

(10) Patent No.: US 6,325,479 B1
(45) **Date of Patent: *Dec. 4, 2001**

(54) INK JET RECORDING APPARATUS, ELECTRONIC APPARATUS USING THE SAME AND CHANGE CONTROL METHOD THEREFOR

(75) Inventors: Hitoshi Nakamura, Yokohama; Soichi Hiramatsu, Tokyo; Hideki Yamaguchi, Yokohama; Hiroyuki Inoue, Yokohama; Seiji Takahashi, Yokohama; Takashi Nojima, Tokyo; Akira Kida, Yokohama; Hideaki Kawakami, Yokohama; Takeshi Iwasaki, Yohohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 43 days.

(21) Appl. No.: 08/595,807

(22) Filed: Feb. 2, 1996

(30) Foreign Application Priority Data

Feb. 6, 1995 (JP) ..... 7-017948
Mar. 7, 1995 (JP) ..... 7-047240

(51) Int. Cl.[7] ..... B41J 29/393; B41J 2/165; B41J 29/38

(52) U.S. Cl. ..... 347/19; 347/24; 347/87; 347/5

(58) Field of Search ..... 347/19, 23, 24, 347/87, 5, 86, 30, 35, 33

(56) References Cited

U.S. PATENT DOCUMENTS

| | | | | |
|---|---|---|---|---|
| 4,074,318 | * | 2/1978 | Kapes, Jr. | 358/230 |
| 5,049,898 | | 9/1991 | Arthur et al. | 347/19 |
| 5,068,806 | * | 11/1991 | Gatten | 347/23 |
| 5,168,291 | | 12/1992 | Hiramatsu et al. | 347/19 |
| 5,291,224 | | 3/1994 | Asano et al. | 346/134 |
| 5,357,347 | * | 10/1994 | Hirose et al. | 358/296 |
| 5,363,134 | * | 11/1994 | Barbehenn et al. | 347/49 |
| 5,530,462 | * | 6/1996 | Takahashi et al. | 347/23 |
| 5,691,750 | * | 11/1997 | Edwards | 347/19 |
| 5,731,826 | * | 3/1998 | Hirano | 347/19 |
| 5,742,302 | * | 4/1998 | Kohri et al. | 347/23 |

FOREIGN PATENT DOCUMENTS

| | | |
|---|---|---|
| 0 274 435 | 7/1988 | (EP) . |
| 0 374 762 | 6/1990 | (EP) . |
| 0 556 011 | 8/1993 | (EP) . |
| 0 580 421 | 1/1994 | (EP) . |
| 0 585 923 | 3/1994 | (EP) . |
| 0 630 755 | 12/1994 | (EP) . |
| 6-316063 | 11/1994 | (JP) . |

* cited by examiner

*Primary Examiner*—Peter S. Wong
*Assistant Examiner*—Bao Q. Vu
(74) *Attorney, Agent, or Firm*—Fitzpatrick, Cella, Harper & Scinto

(57) ABSTRACT

An ink jet recording apparatus includes a movable carriage capable of moving as designed while carrying, hereon, a plurality of different recording heads for discharging ink to record characters and/or images and a plurality of different ink tanks for storing ink to be supplied to the recording heads, the recording heads and the ink tanks being changeable; a restoring unit capable of restoring the recording heads; a detection unit for determining the type of the recording head or the ink tank; and a control unit for causing the restoring unit to restore the recording head in a case where the detection unit has detected change of the recording head or the ink tank to the recording head or the ink tank of the same type, and inhibiting the restoring unit from restoring the recording head in a case where the detection unit has detected change to the recording head or the ink tank of a different type.

80 Claims, 25 Drawing Sheets

| FIG. 7A |
| --- |
| FIG. 7B |

| FIG. 8A |
| --- |
| FIG. 8B |

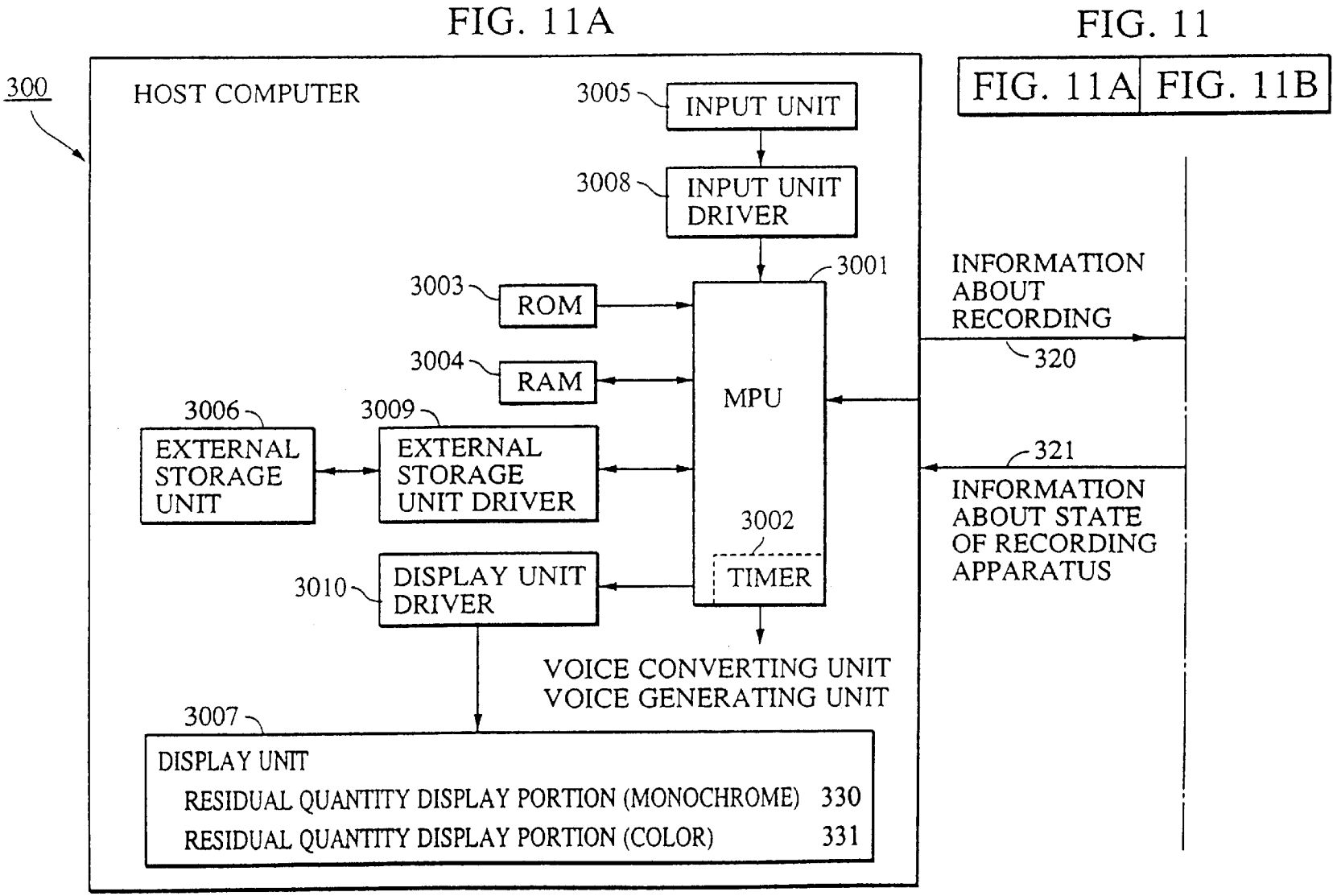
FIG. 11
FIG. 11A
FIG. 11B
INFORMATION ABOUT RECORDING
320
321
INFORMATION ABOUT STATE OF RECORDING APPARATUS
HOST COMPUTER
INPUT UNIT
3005
INPUT UNIT DRIVER
3008
3001
MPU
3002
TIMER
ROM
3003
RAM
3004
EXTERNAL STORAGE UNIT DRIVER
3009
EXTERNAL STORAGE UNIT
3006
DISPLAY UNIT DRIVER
3010
VOICE CONVERTING UNIT
VOICE GENERATING UNIT
DISPLAY UNIT
3007
RESIDUAL QUANTITY DISPLAY PORTION (MONOCHROME) 330
RESIDUAL QUANTITY DISPLAY PORTION (COLOR) 331
300

| FIG. 17A |
| --- |
| FIG. 17B |

FIG. 19

| OPERATION | ROTATION OF PUMP GEAR (FIG.20) |
|---|---|
| ①: SUCTION CAUSES INK TO BE SUCKED THROUGH NOZZLES SO AS TO OVERCOME A STATE WHERE INK IS CLOGGED. | B→C |
| ②: STANDBY AS IT IS FOR ABOUT 3 SECONDS TO SUFFICIENTLY SUCK INK FROM THE HEAD TO THE RESTORATION-SYSTEM. | C IS MAINTAINED |
| ③: THE CAP IS OPENED TO PERFORM PREVIOUS DISCHARGE OPERATIONS THROUGH ALL NOZZLES BY A PREDETERMINED NUMBER OF TIMES TO CAUSE INK AT THE LEADING END OF EACH NOZZLE TO BE IN AN APPROPRIATE STATE FOR PRINTING. | C→E |
| ④: PERFORM IDLE SUCKING OPERATION IN A STATE WHERE THE CAP IS OPENED TO SUCK INK ADHERED TO THE CAP PORTION. THE IDLE SUCKING OPERATION IS PERFORMED 4 TIMES. | E→G→F→G→F→G→F →G→D |
| ⑤: WIPING IS PERFORMED TO WIPE OUT INK, DUST, CONTAINMENT AND THE LIKE ADHERED TO THE PORTION NEAR THE NOZZLE AND THE HEAD FACE. | D→A→I |
| ⑥: WIPER IS CLEANED SO AS TO WIPE OUT INK AND THE LIKE ADHERED TO THE WIPER. | I→H |
| ⑦: THE OPERATION IS RETURNED TO THE STANDBY STATE. | H→A→B |

FIG. 21

| | NUMBER OF INK SUCKING OPERATIONS | NUMBER OF PREVIOUS JETTING OPERATIONS |
|---|---|---|
| RESTORING OPERATION 1 | 3 | 10000 |
| RESTORING OPERATION 2 | 2 | 250 |
| RESTORING OPERATION 3 | 1 | 1000 |
| RESTORING OPERATION 4 | 3 | 10000 |

INK JET RECORDING APPARATUS, ELECTRONIC APPARATUS USING THE SAME AND CHANGE CONTROL METHOD THEREFOR

BACKGROUND OF THE INVENTION

1. Field of the Invention

The present invention relates to an ink jet recording apparatus having a recording head and an ink tank mounted on a carriage thereof and arranged to move the carriage and supply an image signal to the recording head to discharge ink so as to record characters and/or images on a recording medium.

2. Related Background Art

In a computer, a word processor, a facsimile machine, a copying machine, a printer and the like, an ink jet recording apparatus has been widely used as means for recording information on a recording medium, such as paper, because noise generation can be prevented, data can be recorded at high speed and color images can easily be recorded.

The ink jet recording apparatus has a structure including a recording head disposed to oppose a recording medium so that heat energy or the like is used to discharge ink. The ink jet recording apparatus has been accommodated in an individual case or integrally included in the case of an electronic apparatus structured to produce information to be recorded and transmit the information as exemplified by a word processor, a personal computer or a facsimile apparatus which receives information from outside.

An ink jet recording apparatus for performing a color recording operation includes a recording head to be communicated with an ink tank or a recording head formed integrally with an ink tank. There have been widely used ink jet recording apparatuses of a type provided with a restoring apparatus arranged to be in contact with the recording head to absorb ink so as to restore the function of the recording head in order to maintain the quality of characters to be printed.

The conventional ink jet recording apparatus prints color images or the like by using a color recording head including inks in four colors and prints monochrome characters, such as text data, by using a monochrome recording head. That is, the recording heads and ink tanks have been changed to be adaptable to the contents to be printed.

Under the existing conditions, a restoring operation has been automatically performed regardless of the type of the recording head when the recording head has been changed.

However, the conventional structure always and automatically performs the restoring operation whenever change from the color recording head to the monochrome recording head or that from the monochrome recording head to the color recording head is performed. Therefore, if the recording head has been changed frequently, the restoring operation is performed whenever the recording head is changed. As a result, ink is wasted excessively, thus causing ink to be consumed undesirably. In particular, since a portable recording apparatus must attain desired portability, the size of the recording head and that of the ink tank must be reduced as well as the size of the ink jet recording apparatus. Moreover, ink in the ink tank must be restored efficiently when the recording head is changed.

Hitherto, the conventional apparatus usually includes an instruction means for controlling the recording apparatus to be capable of changing the recording head and to instruct the change of the recording head. The state where the change is enabled is exemplified by movement of the carrier for conveying the recording head to a position, at which the recording head can be changed. The instruction means sometimes consists of one or two keys and a variety of change modes are instructed by changing the combination of keys to be depressed or number of depressing operations.

A recording apparatus of the type having the various change modes suffers from a problem in that the change mode cannot accurately be instructed, for example, in a case where the recording head, which is being used, is changed to a new type recording head or a new type recording substance supply means. In the foregoing case, there arise problems in that the quantity of the contained recording substances in the newly mounted recording head or the recording substance supply means or a discharge restoring process, to be performed prior to performing the recording operation, is inaccurate, and that an unnecessary process is performed.

When the instruction means for instructing the change instructs to perform the control operation to enable the recording apparatus to be changed, another problem arises in that the change mode cannot be instructed and, therefore, the recording apparatus, the recording head of which has been changed, cannot be controlled accurately.

If the instruction means for instructing the change consists of one or two keys, a problem arises in that the operation becomes too complicated. What is worse, the complicated operation causes an erroneous instruction to be performed.

SUMMARY OF THE INVENTION

An object of the present invention is to provide an ink jet recording apparatus capable of satisfactorily saving time and reducing ink consumption when a restoring operation is performed due to change of a recording head.

In order to achieve the foregoing object, according to one aspect of the present invention, there is provided an ink jet recording apparatus comprising: a movable carriage capable of moving as designed while carrying, thereon, a plurality of different recording heads for discharging ink to record characters and/or images and a plurality of different ink tanks for storing ink to be supplied to the recording heads, the recording heads and the ink tanks being changeable; restoring means for restoring the recording head; detection means for determining the type of the recording head or the ink tank; and control means for causing the restoring means to restore the recording head in a case where the detection means has detected change of the recording head or the ink tank to the recording head or the ink tank of the same type, and inhibiting the restoring means from restoring the recording head in a case where the detection means has detected change to the recording head or the ink tank of a different type.

Since the detection means for detecting the type of the recording head is provided in the structure according to the present invention, the control means determines whether the restoring operation must be performed when the recording head has been changed. As a result, the quantity of ink to be consumed when the recording head is changed can be reduced.

According to another aspect of the present invention, there is provided a recording apparatus having display means for displaying the plurality of change modes concerning change to be performed in the recording apparatus and an electronic apparatus that can be electrically connected to the recording apparatus; instruction means for selecting a desired change mode from the plurality of change modes displayed on the display means; and control means for controlling the recording apparatus in accordance with an instruction issued by the instruction means.

According to the present invention, a change mode selected from a variety of the change modes is instructed to be performed when the recording head or the recording substance supply means is changed. The recording apparatus is controlled in accordance with the instruction issued by the instruction means.

Other objects, features and advantages of the invention will be evident from the following detailed description of the preferred embodiments described in conjunction with the attached drawings.

BRIEF DESCRIPTION OF THE DRAWINGS

FIG. 19 is a table for explaining a discharge restoring process according to the embodiment of the present invention;

FIG. 21 is a table for explaining the restoring operation according to the embodiment of the present invention.

DETAILED DESCRIPTION OF THE INVENTION

Preferred embodiments of the present invention will now be described.

The embodiment of the present invention has a structure comprising recording means having a recording head mounted on a carriage, the structure of which is similar to that of the conventional ink jet recording apparatus, and arranged to discharge ink to a recording medium in order to record data; a restoring means for restoring the function of the recording head; and a control means for controlling the operation of the ink jet recording apparatus. The structure of this embodiment is characterized by a detection means for discriminating the type of the recording head or the ink tank; and the structure of the control means that has a function capable of reliably discriminating as to whether the recording head or the ink tank removed from the carriage has been changed to the same type recording head or the ink tank or a different type recording head or an ink tank so as to control the restoring means.

The detection means may be adapted to a detection method for detecting contact of the recording head or the ink tank with the outer surface that becomes different depending upon the type of the recording head or the ink tank or a non-contact detection method.

Figure 1:
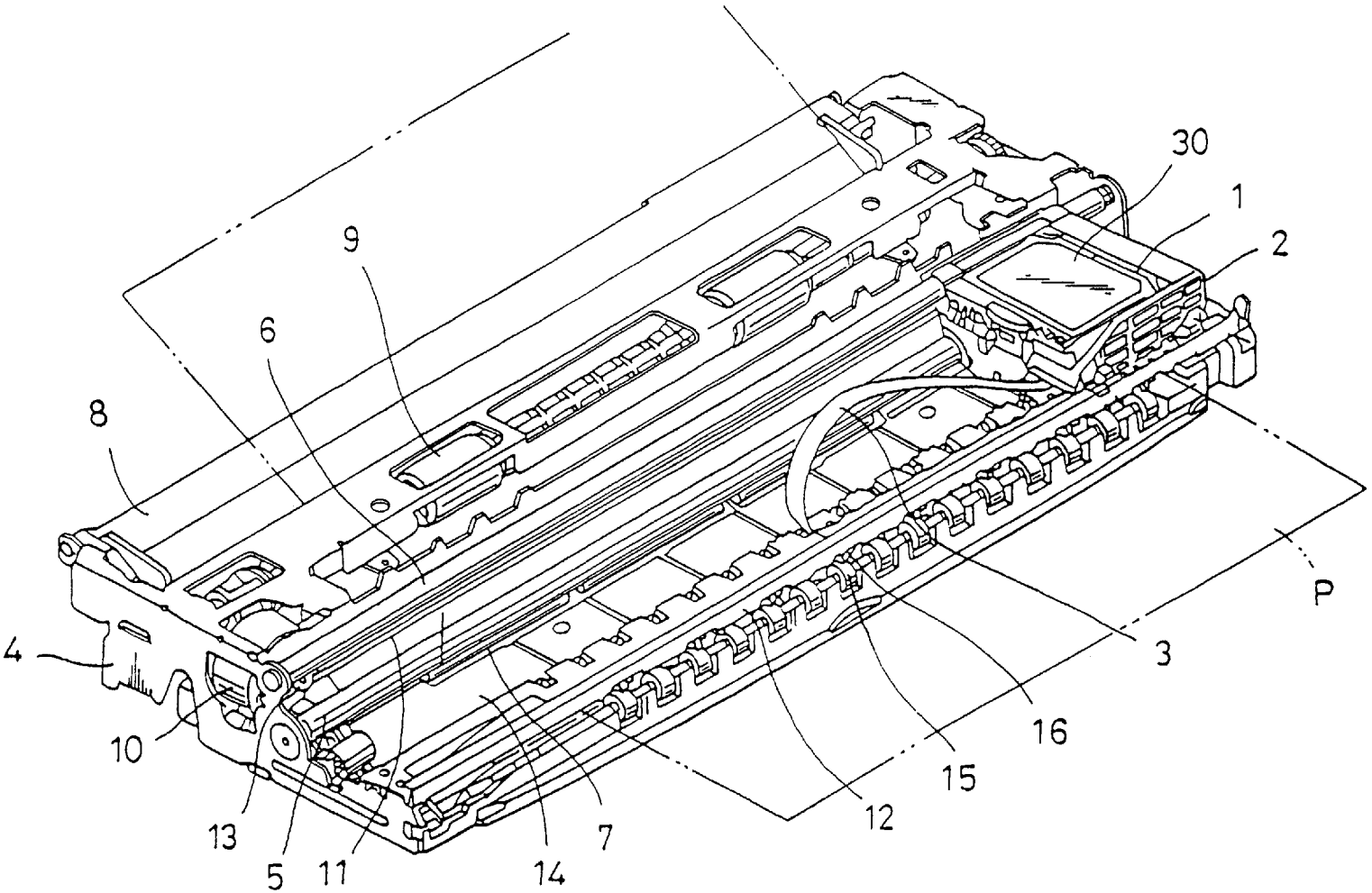
FIG. 1 is a perspective view showing an embodiment of an ink jet recording apparatus according to the present invention.

FIG. 1 is a perspective view showing an embodiment of an ink jet recording apparatus according to the present invention. Referring to FIG. 1, a carriage 2 for detachably carrying a recording head cartridge 1 is supported by a guide shaft 5 and a guide rail 12, the two ends of each of which are secured to a frame 4 and which are disposed to run parallel to each other, the carriage 2 being allowed to slide in a direction perpendicular to a direction, in which a recording medium P is moved, which is in parallel to the surface of the recording medium P. The carriage 2 is connected to a portion of a carriage drive belt 11 arranged between a drive pulley 13, secured to an output shaft of a carriage drive motor 10, and a rotative follower pulley (not shown). As a result, when the carriage drive motor 10 is rotated, the carriage drive belt 11 is rotated so that the carriage 2 is allowed to reciprocate in the foregoing directions.

The recording head cartridge 1 is an ink tank holder having a nozzle portion serving as a recording head for discharging ink in response to a recording signal, which is an electric signal for causing ink to be discharged; and a mono-color holder. An ink tank 30 for containing ink is detachably held by the mono-color holder. The nozzle portion is formed in the bottom (at the lower end of FIG. 1) of the recording head cartridge 1 so that ink is discharged downwards. The recording signal, to be supplied to the nozzle portion, is transmitted from a control board (not shown) for controlling the operation of the ink jet recording apparatus through a flexible cable 3 arranged in the carriage 2. The flexible cable 3 is arranged in a direction, in which the carriage 2 is moved, in such a manner that the flexible cable 3 forms a loop due to the movement of the carriage 2. The recording head cartridge 1 and the carriage 2 will be described later.

The recording mediums P are stacked on a pressing plate 8 having two ends rotatively supported by the frame 4. The pressing plate 8 is, by an urging means (not shown), urged to a pickup roller 9 so that the recording mediums P stacked on the pressing plate 8 are pressed against the pickup roller 9. When the pickup roller 9 is rotated following a paper-supply command, the frictional force generated between the pickup roller 9 and the recording medium P pushes the recording medium P. The pressing plate 8 has a separating means (not shown), such as a separating claw which has been employed in a conventional automatic paper-supply apparatus, so that the separating means acts to feed the uppermost recording medium P.

The recording medium P, fed by the pickup roller 9, is, while being held by a conveying roller 6 and a pinch roller 7 provided for a base 14, moved to a position below the carriage 2. Information is recorded on the recording medium P at the foregoing position. A paper-discharge roller 15 and a wheel 16 opposing to each other are disposed downstream of the carriage 2 in the direction, in which the recording medium P is moved, so that the recording medium P passed below the carriage 2 is held between the paper-discharge roller 15 and the wheel 16 before the recording medium P is discharged. The pickup roller 9, conveying roller 6 and the paper-discharge roller 15 are rotated by a paper-feeding motor (not shown).

In the following description, the upstream direction with respect to the direction, in which the recording medium P is moved, is called a forward portion, the forward surface is called a back surface, the downstream direction is called a rearward portion, and the rearward surface is called a front surface.

Figure 2:
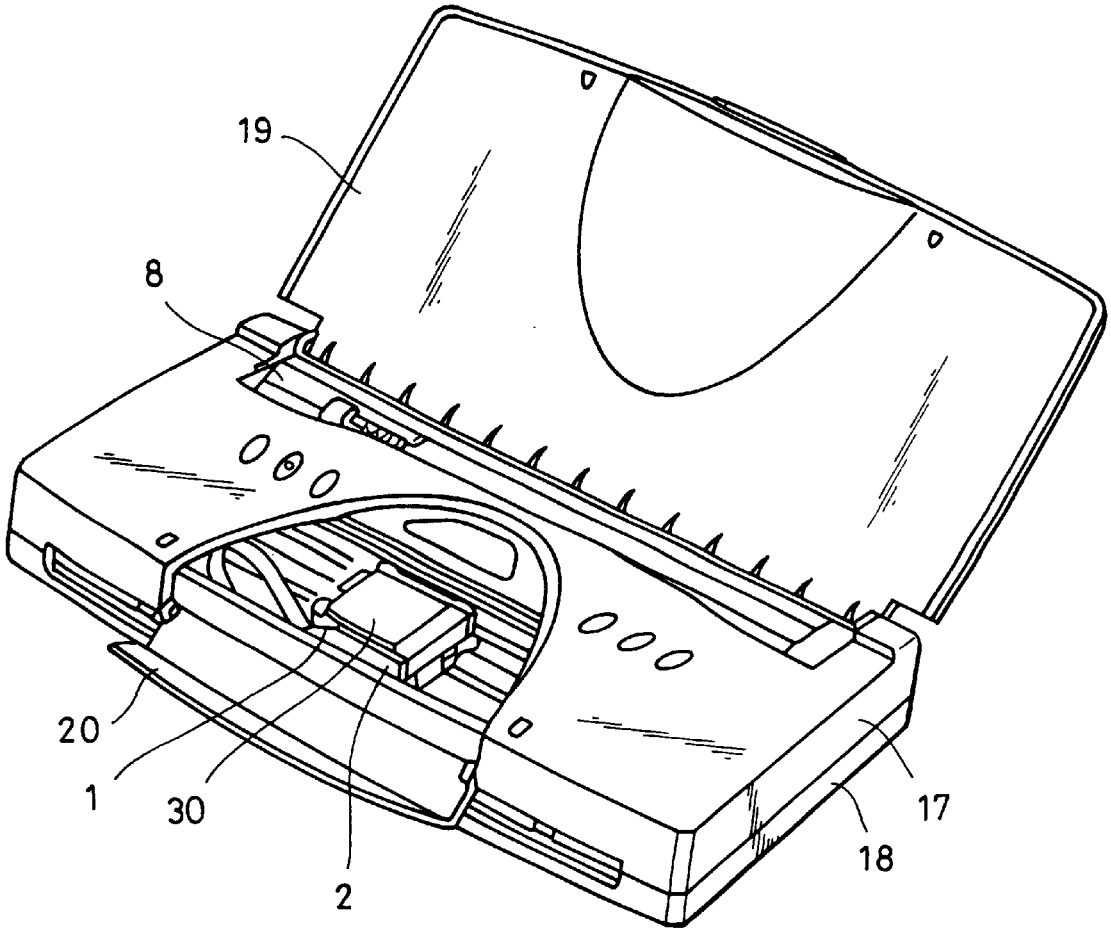
FIG. 2 is a perspective view showing a recording head cartridge according to the embodiment of the present invention and accommodated in a case of the ink jet recording apparatus.

FIG. 2 is a perspective view showing a state where the ink jet recording apparatus shown in FIG. 1 is accommodated in a case for the apparatus. As shown in FIG. 2, the case consists of an upper case 17 and a lower case 18. The case accommodates the ink jet recording apparatus shown in FIG. 1.

The upper case 17 includes, in the forward portion thereof, a top cover 19 for covering the upper case 17, the top cover 19 being permitted to be opened/closed as desired. The upper case 17 has an opening at a position corresponding to the pressing plate 8. When the top cover 19 is opened, the top cover 19 serves as a tray for setting the recording medium P on the pressing plate 8. The upper case 17 further comprises an opening formed from the central portion thereof to the front surface thereof. Thus, the recording head cartridge 1 or the ink tank 30 can be mounted/removed through the foregoing opening. Therefore, when the recording head cartridge 1 or the ink tank 30 is changed, the carriage 2 is moved to the central portion of the movable range for the carriage 2 due to a predetermined operation. In front of the opening for changing the recording head cartridge 1 or the ink tank 30, there is disposed a head cover 20, permitted to be opened/closed as desired, and arranged to cover a portion or the front surface of the opening. When the recording head cartridge 1 or the ink tank 30 is not changed, the head cover is closed to protect the recording head cartridge 1.

Figure 3:
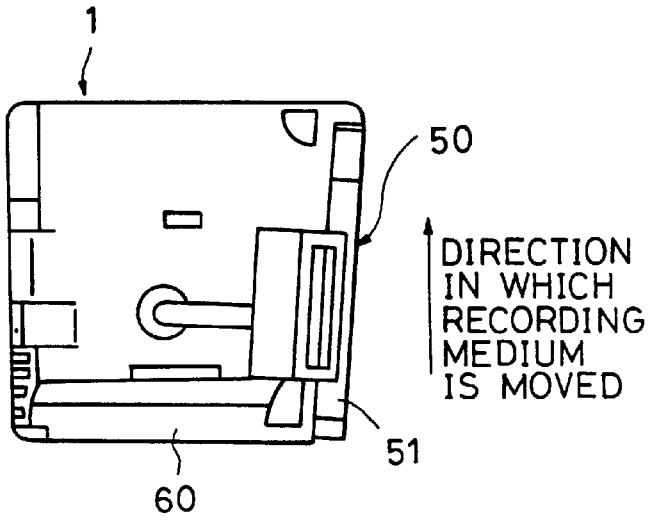
FIG. 3 is a bottom view showing the recording head cartridge according to the embodiment of the present invention.
Figure 4:
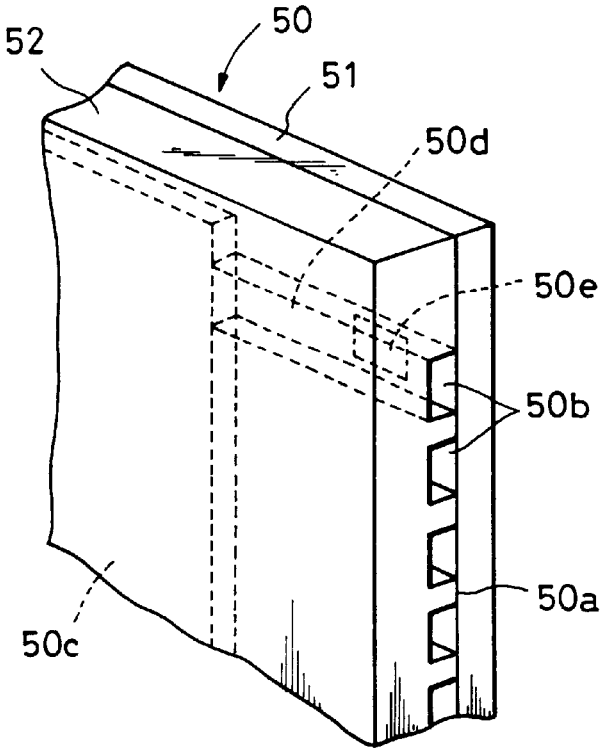
FIG. 4 is an enlarged perspective view showing an essential portion of the recording head cartridge according to the embodiment of the present invention.

FIG. 3 is a bottom view of the recording head cartridge 1 of the ink jet recording apparatus shown in FIG. 1. FIG. 4 is an enlarged perspective view showing an essential portion of a nozzle portion 50 of the recording head cartridge 1 shown in FIG. 3.

The recording head cartridge 1 is a mono-color cartridge having the nozzle portion 50 for discharging ink; and a mono-color holder 60 having an opening on the top surface thereof and formed into a box-like shape, the nozzle portion 50 and the mono-color holder 60 being formed integrally. The mono-color holder 60 includes an ink tank 30 for containing mono-color ink.

The nozzle portion 50 is, as shown in FIG. 4 in an enlarged manner, formed by securing a groove-formed member 52, having a plurality of liquid passages 50*d* and grooves forming a common liquid chamber 50*c*, to a base plate 51 made of metal, such as aluminum. A discharge port surface 50*a* opposing the recording medium P (see FIG. 1) has a plurality of discharge ports 50*b* serving as opening ends of the liquid passages 50*d*. The liquid passages 50*d* are formed at predetermined pitches, and electrothermal converters (heat resistors or the like) 50*e* for generating energy for discharging ink are disposed on the base plate 51 to correspond to the liquid passages 50*d*. The common liquid chamber 50*c* is communicated with the ink tank 30, to which ink is supplied from the ink tank 30. Each elecrothermal converter 50*e* is electrically connected to a head terminal portion through electric wires (not shown).

The head terminal portion is an electric board secured to the base plate 51 and made of epoxy glass or the like. The wire connected to each elecrothermal converter 50*e* is connected to the head terminal portion by wire bonding. The base plate 51 is, as shown in FIG. 3, attached such that it is inclined to make an angle of 1° to 4° with respect to the direction in which the recording medium P is moved. Therefore, the row of the discharge ports 50*b* is inclined by an angular degree of 1° to 4° with respect to the direction in which the recording medium P is moved.

Ink, supplied from the ink tank 30 to the common liquid chamber 50*c* and temporarily stored there, is introduced into the liquid passages 50*d* due to capillarity and forms meniscus at each of the discharge ports 50*b* so that a state is maintained in which the liquid passages 50*d* are filled with the ink. When electric power is supplied to the electrothermal converters 50*e* in response to the recording signal transmitted to the head terminal portion and, therefore, the electrothermal converter 50*e* generate heat, the ink placed on the electrothermal converters 50*e* is rapidly heated and film-boiled. As a result, bubbles are generated in the liquid passages 50*d*, and expansions of the bubbles cause the ink to be discharged through the discharge ports 50*b*. Although the electrothermal converters 50*e* are employed as the energy generators for generating energy, the present invention is not limited to the electrothermal converters 50*e*. Piezoelectric devices for generating mechanical energy, with which discharging pressure is spontaneously applied, may be employed.

An operation of attaching/detaching the ink tank 30 to the mono-color holder 60 will now be described.

Figure 5:
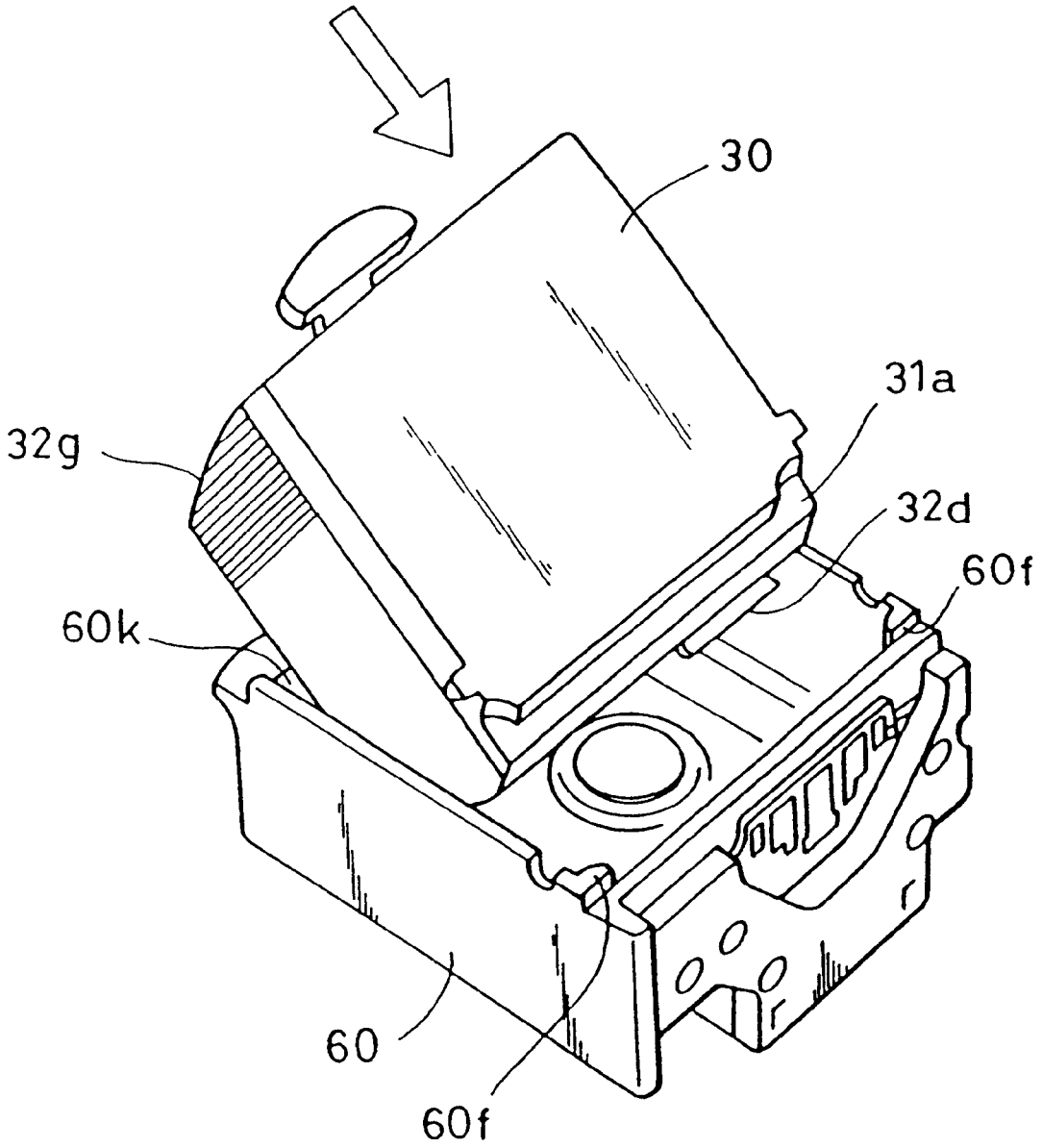
FIG. 5 is a perspective view showing a state where an ink tank according to the embodiment of the present invention is mounted.

When the ink tank 30 is attached to the mono-color holder 60, a member for sealing the ink supply port is separated. Then, the ink tank 30 is, as shown in FIG. 5, inserted diagonally as indicated by an arrow of FIG. 5, from a portion, in which a separation preventive claw 32*d* is formed, so that a stepped portion 31*a* of the ink tank 30 is inserted below each projections 60*f* of the mono-color holder 60. Then, the separation preventive claw 32*d* of the ink tank 30 is hooked by a tank separation preventive hole of the mono-color holder 60 so that the ink tank 30 is located roughly. Since the ink tank 30 has an inclined surface 32*g* to serve as a guide for making the inclined surface 32*g* to be in parallel to the bottom surface of the mono-color holder 60, the ink tank 30 can be inserted into the mono-color holder 60 in such a manner that the stepped portion 31*a* of the ink tank 30 can easily be inserted below the projections 60*f*. Since the mono-color holder 60 and the ink tank 30 have inclined surfaces 60*k* and 32*g* corresponding to each other, an ink tank of a different type cannot be mounted. Thus, unintentional mounting of an ink tank can be prevented.

Figure 6:
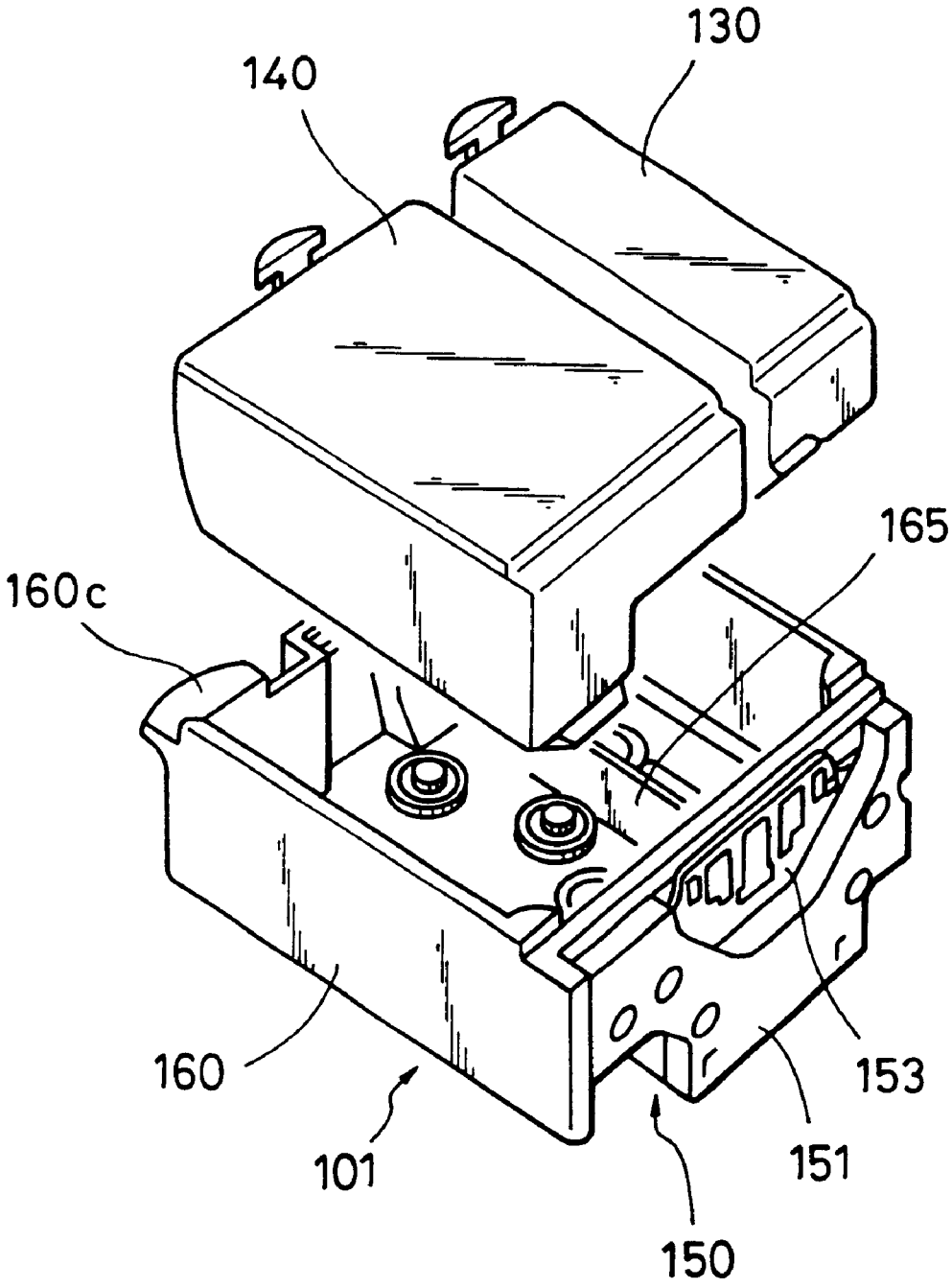
FIG. 6 is a perspective view showing a state where the ink tank according to the embodiment of the present invention is mounted.

FIG. 6 is a perspective view showing a color recording head cartridge, to be mounted on the ink jet recording apparatus shown in FIG. 1, and two ink tanks to be mounted on the foregoing color recording head cartridge. The color recording head cartridge 101 has a structure enabling a black ink tank 130 for containing black ink and a color ink tank 140 for containing yellow, magenta and cyan inks to be mounted/removed so that four color inks are discharged. Therefore, a nozzle portion 150 is sectioned into a black ink discharge port group 150B, a yellow ink discharge port group 150Y, a magenta ink discharge port group 150M and a cyan ink discharge port group 150C (not shown). To divide regions on which the black ink tank 130 and the color ink tank 140 are mounted, a partition plate 165 is integrally formed with the bottom wall of the color holder 160.

A head plate 151 and a head terminal portion 153 have the same structures as those of the mono-color recording head cartridge 1. Also the color holder 160 has substantially the same external shape as that of the mono-color recording head cartridge 1 except for delicate differences. In particular, the color holder 160 has the same structure such that its shape relating to the carriage 2 and the position of a head attaching/detaching operation portion 160*c* serving as a portion, which is hooked by the finger when the color recording head cartridge 101 is removed from the carriage 2, are the same. Therefore, the color recording head cartridge 101 can be mounted/removed with respect to the carriage 2, which is the same as the foregoing carriage 2 on which the mono-color recording head cartridge 1 is mounted. That is, a user is permitted to select and mount either of the mono-color recording head cartridge 1 or the color recording head cartridge 101 on one ink jet recording apparatus.

Figure 7A:
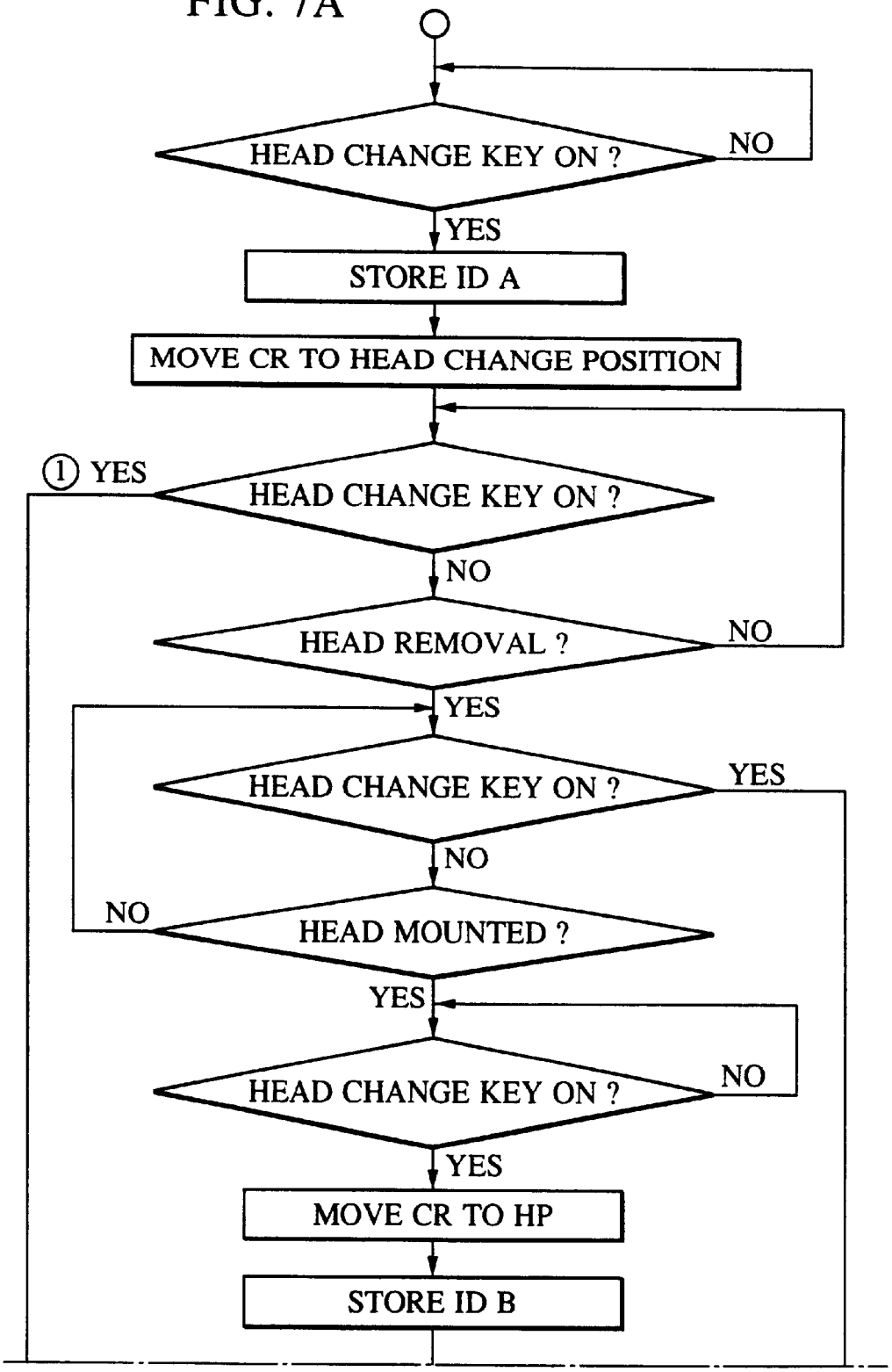
FIG. 7, which is comprised of FIGS. 7A and 7B, is a flow chart of the operation according to the embodiment of the present invention.
Figures 7, 7B:
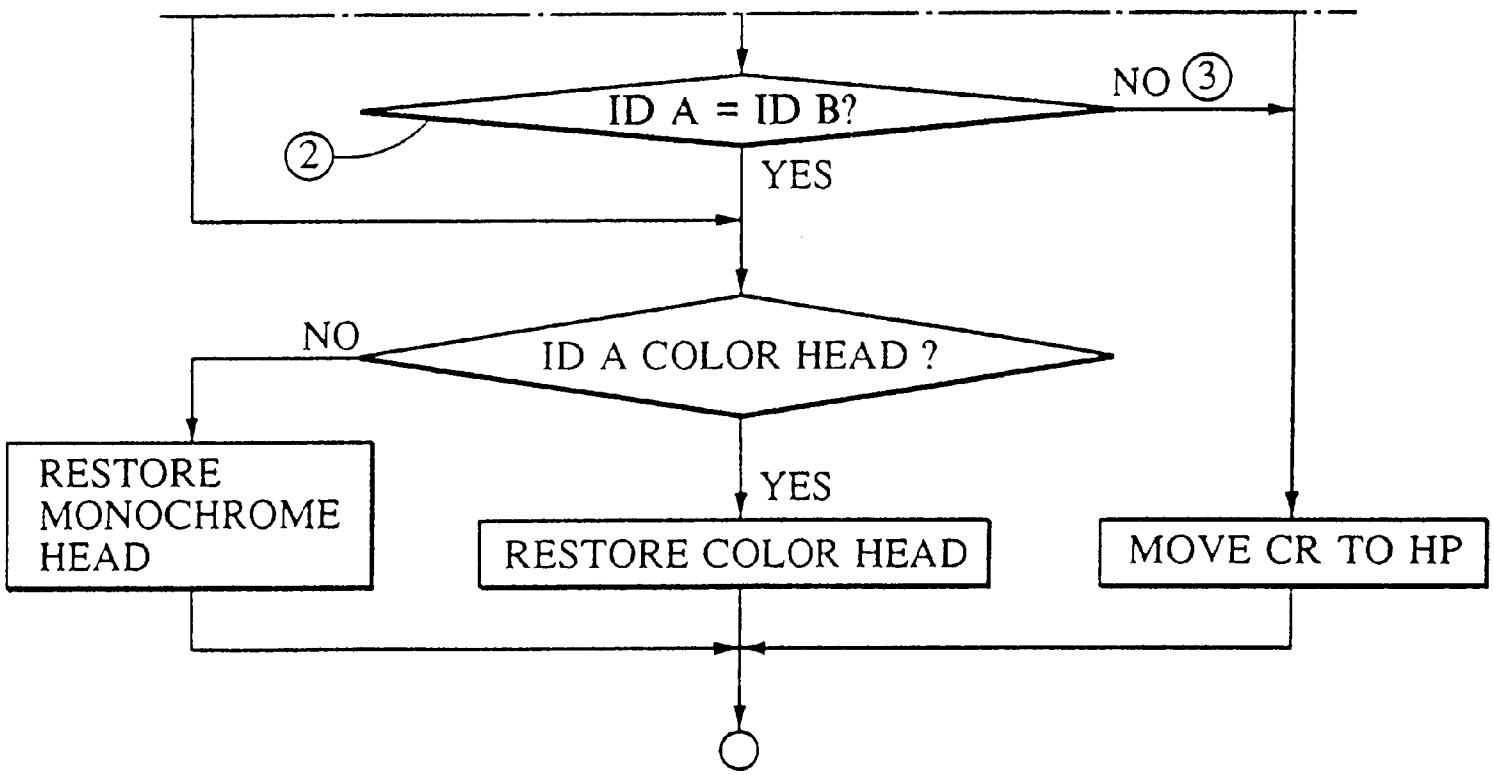

FIG. 7 is a flow chart showing a restoring sequence to be performed when the head is changed in the structure of the first embodiment. Referring to FIG. 7, the characterized operation of this embodiment will now be described.

When a head change key (not shown) is depressed, the type (ID) of the recording head mounted on the recording apparatus is discriminated. The carriage (CR) is moved to the position, at which the recording head is changed, in accordance with a change command. Assuming that ink, which is being used, has been consumed and the printing operation has not been completed, only the ink tank is changed and the recording head is not changed. Since, generated bubbles, however, exist in the ink passage in the recording head, the operation proceeds along a route (1) when only the ink tank has been changed so that a restoring operation corresponding to the type of the recording head is performed.

An assumption is now made that the recording head has been changed. In the trend of using color personal computers, the printing operations are performed to be adaptable to the case where a monochrome printing operation is desired to print a report or the like and the case where a color printing operation is desired at the time of performing a presentation or writing new year cards so that the running cost is reduced significantly. When a recording head having color ID (identification code) A has been changed to a recording head having monochrome ID code B for example, ID A and ID B are different from each other in step (2), the operation proceeds along route (3) so that the carriage (CR) is returned to the home position (HP) and, therefore, monochrome printing is enabled. Since the monochrome recording head is a used recording head in this case, printing can be performed even if the restoring operation is not performed. Also in the case where a monochrome recording head has been changed to a color recording head, the restoring operation is not performed similarly.

Therefore, the restoring operation is not required whenever the recording head is changed, so that the quantity of consumption of ink in the ink tank is reduced. Moreover, the capacity of the ink tank can be reduced, the quantity of waste ink to be stored in the recording apparatus after the restoring operation has been performed can be reduced. As a result, the size of the recording apparatus can be reduced and, therefore, satisfactory portability can be realized. Since no restoring operation is performed, the printing operation can be performed immediately after the change has been performed.

Figure 8A:
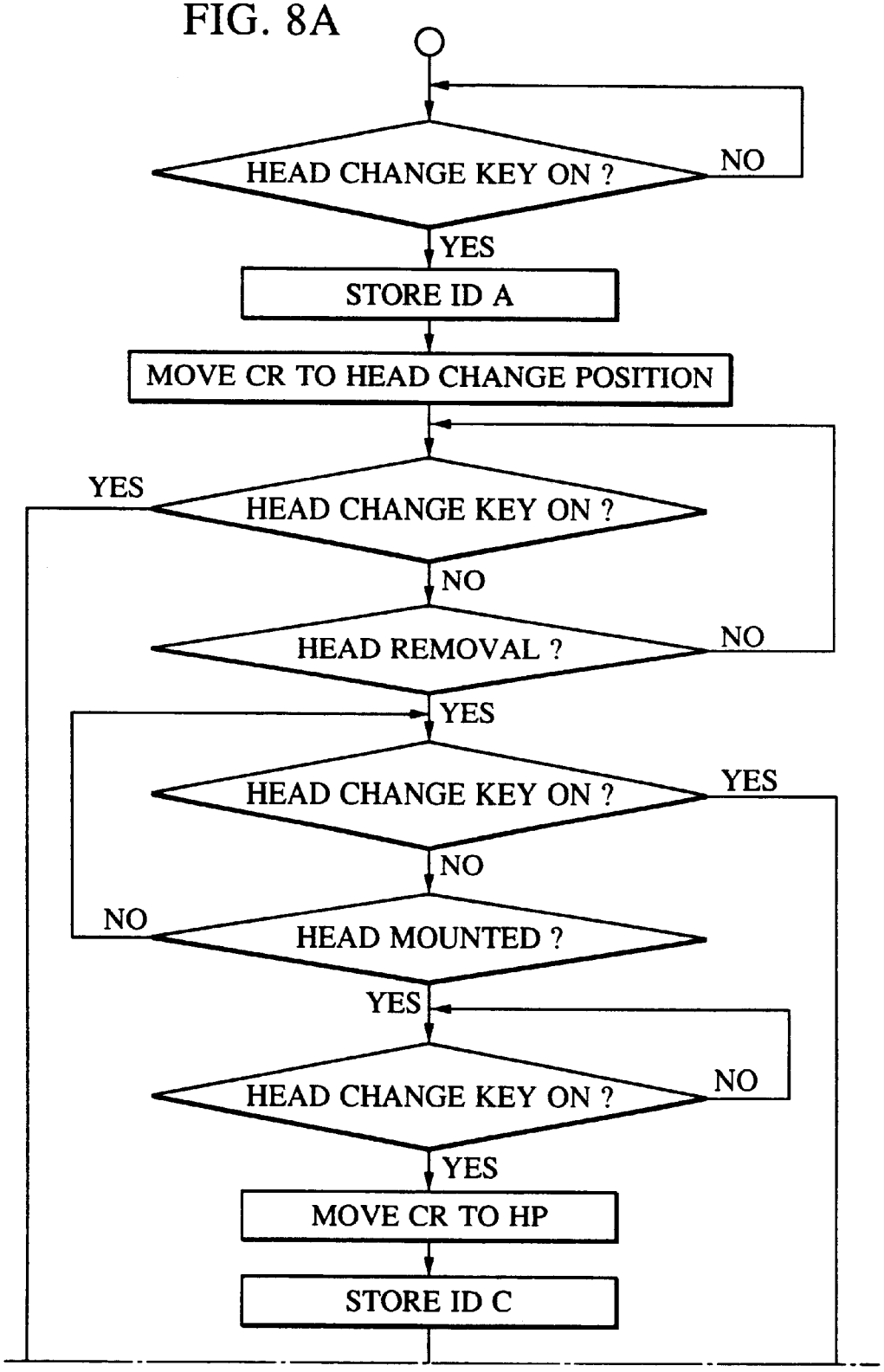
FIG. 8, which is comprised of FIGS. 8A and 8B, is a flow chart of the operation according to another embodiment of the present invention.
Figures 8, 8B:
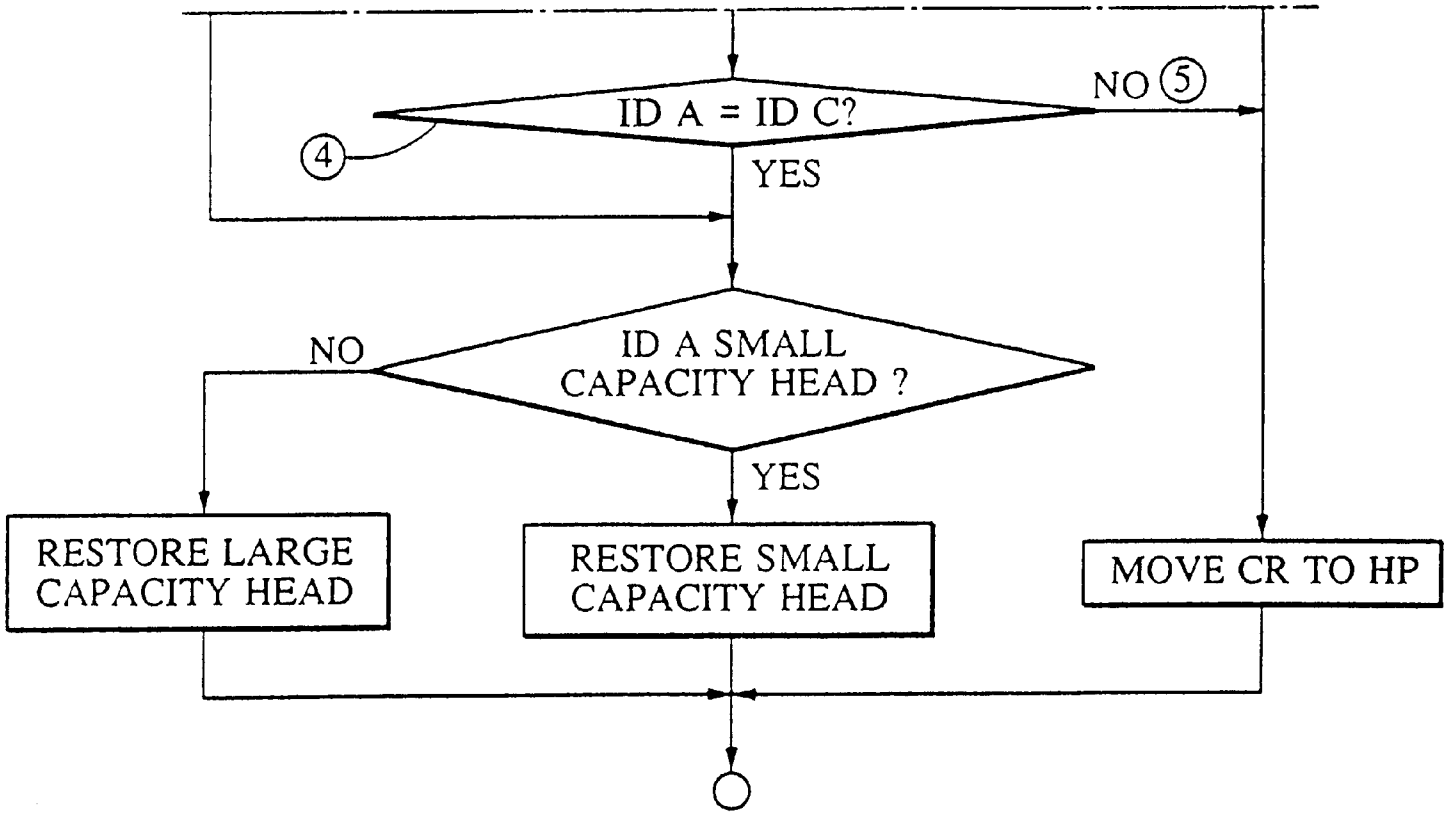

FIG. 8 is a flow chart of a control operation to be performed when the recording head is changed in the structure according to a second embodiment of the present invention. This embodiment is intended to satisfy the desired portability and a requirement for use as the desk top type ink jet recording apparatus. In a case where the portability is required, a recording head having a small-size tank is used and it is subjected to the restoring operation as has been done in the first embodiment.

In a case where hundreds of sheets are recorded or ink is consumed in a large quantity per one sheet, it is convenient to use a recording head exhibiting a capacity for containing ink larger than the foregoing recording head. If the foregoing recording head is given ID code C, the restoring operation is not performed if a recording head of a different type has been mounted. Therefore, ink consumption at the time of changing the recording head can be prevented. In the foregoing case, the arrangement is effective on the promise that the recording head to be changed is in a state where it is able to perform the printing operation.

Referring to the flow chart shown in FIG. 8, whether ID A=ID C is determined in step (4). If ID C indicates a large capacity head and, therefore, its type is different from the head having ID A, the operation proceeds along route 5. Since no restoring operation is performed, the object of the second embodiment can be achieved.

As described above, according to the present invention, the detection means for determining the type of the recording head is provided to determine whether the restoring operation must be performed at the time of changing the recording head. Therefore, the ink tank mounted on the recording head can efficiently be restored and the quantity of ink, which is consumed due to the restoring operation, can be reduced.

Since the number of the restoring operations can be decreased, the space for storing the waste ink sucked due to the restoring operation can be reduced and, therefore, the size of the recording apparatus can be reduced. Since the printing operation can be performed immediately after the change has been performed, the time required to restore the recording state can be omitted.

Figure 9:
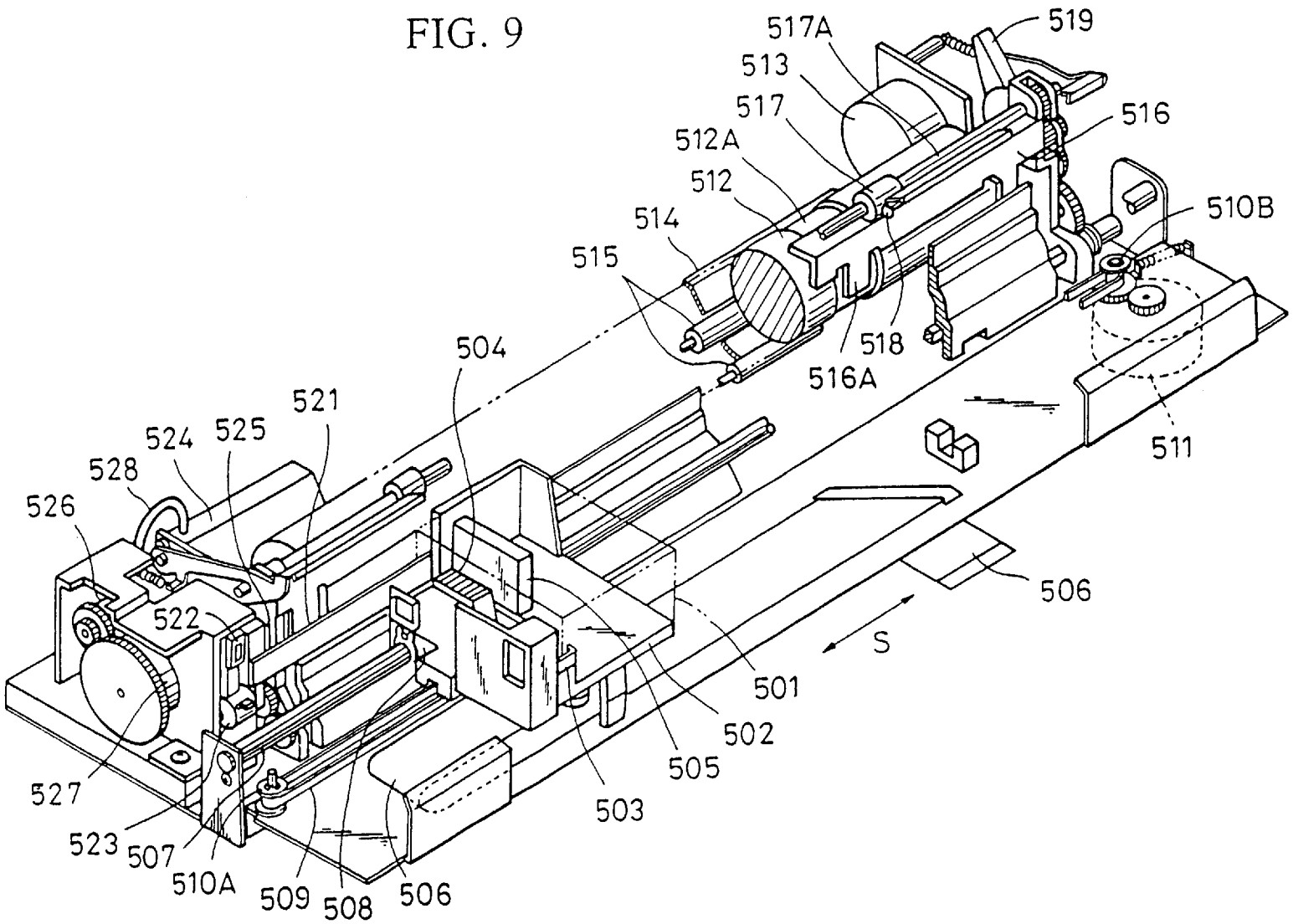
FIG. 9 is a perspective view showing the schematic structure of a recording apparatus according to another embodiment of the present invention.

FIG. 9 is a perspective view showing an essential portion of an ink jet recording apparatus according to another embodiment of the present invention. Referring to FIG. 9, reference numeral 501 represents a head cartridge having an ink jet recording head and provided for a recording apparatus in such a manner that it can be changed to mount a monochrome recording head when a monochrome recording operation is performed and to mount a color recording head when a color recording operation is performed. The recording head, which is not being used, is stored in a storage box (not shown). Reference numeral 502 represents a carrier for carrying the head cartridge 501 to carry the same in a direction S. Reference numeral 503 represents a hook for attaching the head cartridge 501 to the carrier 502. Reference numeral 504 represents a lever for operating the hook 503. Reference numeral 505 represents a support plate for supporting an electrical connection portion with respect to the head cartridge 501. Reference numeral 506 represents an FPC (Flexible Printing Circuit) for establishing the connection between the foregoing electrical connection portion and a control unit in the body of the apparatus. Reference numeral 507 represents a guide shaft for guiding the carrier 502, the guide shaft 507 being inserted into a shaft receiver 508 of the carrier 502. Reference numeral 509 represents a timing belt, on which the carrier 502 is mounted, and arranged to transmit power to move the carrier 502 in the direction S, the timing belt 509 being arranged between pulleys 510A and 510B disposed at the two ends of the apparatus. The pulley 510B receives drive force from a carrier motor 511 through a transmission mechanism, such as gears. Reference numeral 512 represents a conveyance roller for controlling the recording surface of the recording medium, such as paper, and for controlling the recording medium when the recording operation is performed, the conveyance roller 512 being rotated by a conveyance motor 513. Reference numeral 514 represents a paper pan for guiding the recording medium P to a recording position. Reference numeral 515 represents a pinch roller disposed at an intermediate position of a passage, through which the recording medium is moved, and arranged to press the recording medium against the conveyance roller 512 so as to move the recording medium. Reference numeral 516 represents a platen opposing the discharge ports of the head cartridge 501 and controlling the recording surface of the recording medium. Reference numeral 517 represents a paper-discharge roller discharged downstream from the recording position in the direction, in which the recording medium is moved, and arranged to discharge the recording medium to a discharge port (not shown). Reference numeral 518 represents a wheel disposed to correspond to the paper-discharge roller 517 and presses the paper-discharge roller 517 through the recording medium in order to cause the paper-discharge roller 517 to generate the force for moving the recording medium. Reference numeral 519 represents a suspension lever for suspending urging performed by the pinch roller 515 and the wheel 518 when the recording medium is set. The platen 516 is, at the two ends thereof, rotatively supported by the shaft of the paper-discharge roller 517, and urged toward a front surface 521 of the paper pan 514 from a position at which right and left plates 520 are stopped. A plurality of portions 512A of the conveyance roller 512, each having a diameter smaller than the outer diameter of the conveyance roller 512, are in contact with the inside of a front surface 521 of the paper pan 514. Reference numeral 522 represents a cap opposing the surface of the recording head, in which the discharge ports are formed, and made of an elastic material, such as rubber, the cap 522 being supported so as to be brought into contact with/separated from the recording head. The cap 522 protects the recording head when the recording operation is not performed and when the operation for restoring discharge of the recording head is performed. The discharge restoring operation is an operation (previous discharge) having steps of causing the cap 522 to oppose the surface, in which the ink discharge ports are formed, and operating the energy generating devices, disposed in the ink discharge port, to discharge ink through all of discharge ports so as to remove factors preventing discharge of ink, such as bubbles, dust or ink, the viscosity of which has been raised excessively when used in a recording operation. The discharge restoring operation includes an operation having a step of forcibly discharging ink through the discharge ports in a state where the surface, in which the ink discharge ports are formed, is covered with the cap 522 to remove the factors to prevent discharge. Reference numeral 523 represents a pump for causing suction force for forcibly discharging ink and for sucking ink received in the cap 522 when the discharge restoring operation is performed by the forcible discharge or the discharge restoring operation by the previous discharge. Reference numeral 524 represents a waste-ink tank for storing waste ink sucked by the pump 523. The waste-ink tank 524 is connected to the pump 523 through a tube 528. Reference numeral 525 represents a blade for wiping the surface of the recording head, in which the ink discharge ports are formed, the blade 525 being supported in such a manner that it can be moved between a position, at which it projects toward the recording head to wipe the surface during the movement of the carrier 502, and a position moved away from the surface in which the ink discharge ports are formed. Reference numeral 526 represents a restoring system motor. Reference numeral 527 represents a cam unit for receiving power from the restoring system motor 526 to operate the pump 523 and move the cap 522 and the blade 525. The head cartridge 501 will now be described in detail.

Figure 10:
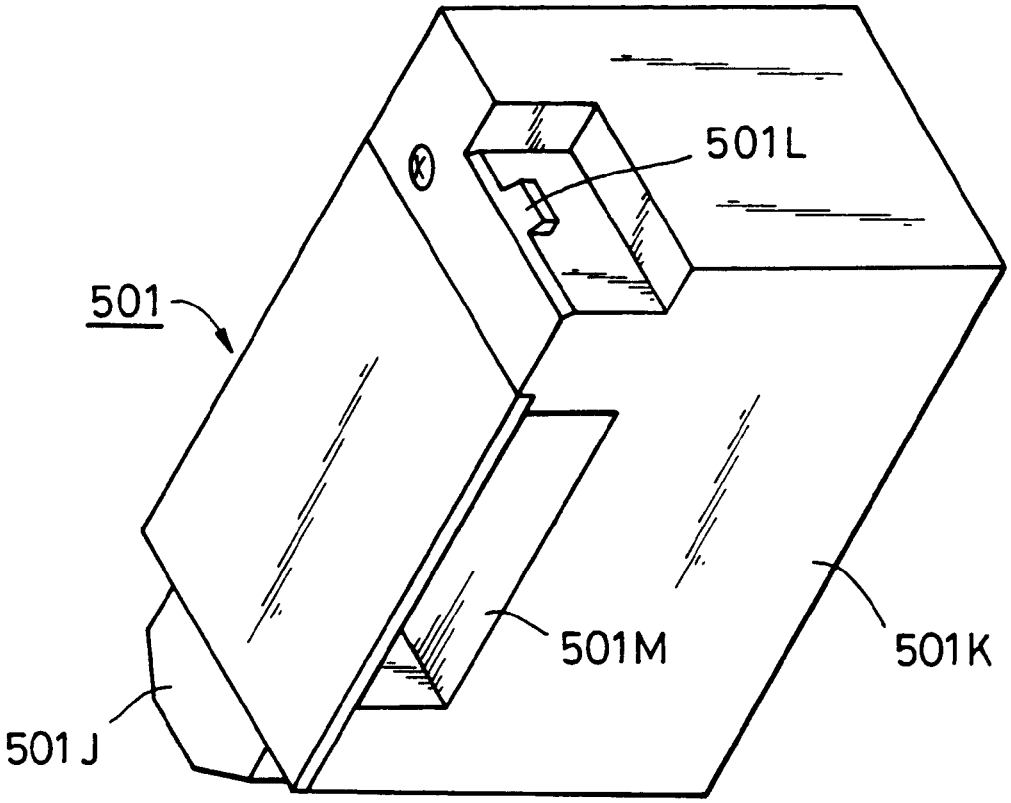
FIG. 10 is a perspective view showing the shape of the head cartridge for use in the recording apparatus shown in FIG. 9.

FIG. 10 is a perspective view showing the head cartridge 501 formed by integrating a discharge unit 501J, serving as the body of the ink jet recording head, and an ink tank 501K, serving as a recording substance supply means for containing ink, which is the recording substance, and supplying the ink to the recording head. The ink tank 501K of the head cartridge shown in FIG. 10 is structured to be changeable with respect to the head cartridge by a mechanism (not shown). The color recording head cartridge has a black ink tank for supplying black ink and a color ink tank for supplying color ink in such a manner that they can be changed. The color ink tank contains yellow, magenta and cyan inks in such a manner that the ink can be supplied. Referring to FIG. 10, a claw 501L is hooked by a hook 503 formed on the carrier 502 when the head cartridge 501 is mounted. As can be understood from FIG. 10, the claw 501L is disposed on the inner surface of the outermost surface of the head. In front of the head cartridge 501 and near the discharge unit 501J, there is disposed a locating stopper (not shown). A head opening 501M is formed through which the support plate 505 is inserted, the support plate 505 being stood erect on the carrier 502 and arranged to support the flexible board (electrical connection portion) and the rubber pad.

Figure 11B:
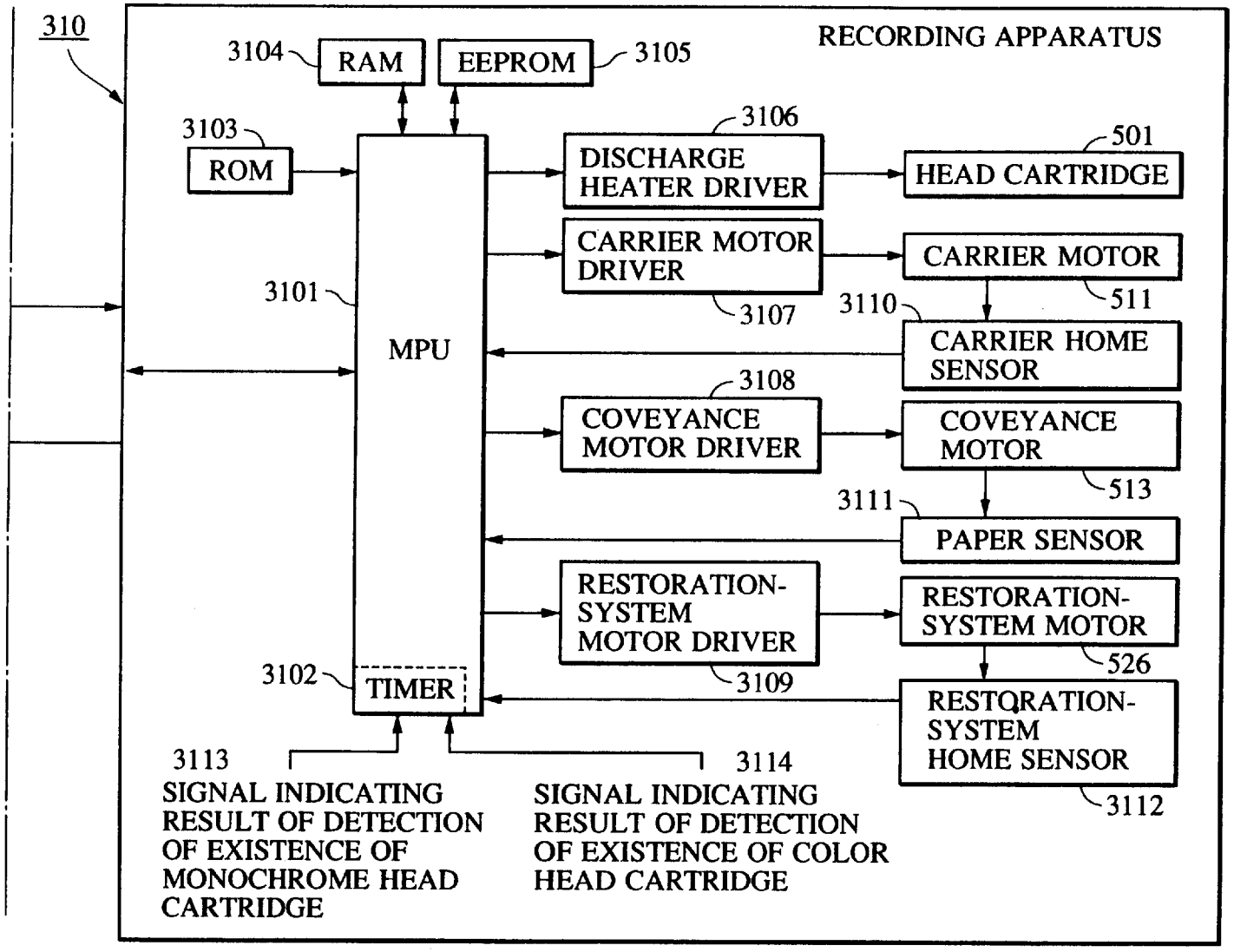
FIG. 11, which is comprised of FIGS. 11A and 11B, is a block diagram showing the structure of a control circuit of the recording apparatus shown in FIG. 9.

FIG. 11 is a block diagram showing the structure of a control circuit of the recording apparatus according to an embodiment of the present invention. Arrows shown in FIG. 11 indicate directions in which signals are transmitted. Reference numeral 300 represents a host unit, such as a computer or a word processor. Reference numeral 3001 represents an MPU for controlling the overall operations of the host unit 300, the MPU 3001 having a timer portion 3002 for counting time lapse in performing the control. The host unit 300 is controlled by a control program or a variety of data items stored in a ROM 3003 or an external storage unit 3006, such as a floppy disk or a hard disk. Reference numeral 3004 represents a RAM to serve as a work area when the control is performed or a buffer area for storing data input from an input unit 3005, such as a keyboard. Reference numeral 3007 represents a display unit, such as a CRT or an LCD, and arranged to display information relating to recording, such as information to be recorded by the recording apparatus. Reference numerals 3008, 3009 and 3010 represent drives for respectively controlling or operating the input unit 3005, the external storage unit 3006 and the display unit 3007. Similarly to the host unit 300, the recording apparatus 310 comprises an MPU 3101 for controlling the recording apparatus 310, a timer portion 3102, a ROM 3103 and a RAM 3104. An EEPROM 3105 is an electrically erasable ROM for storing recorded data even if the power supply to the apparatus is turned off, the EEPROM 3105 storing the quantity of consumption of the recording substance or the residual quantity of the same. When the recording operation is performed, recording information 320 transmitted from the MPU 3001 of the host unit 300 is stored in the RAM 3104 of the recording apparatus 310. Then, the MPU 3101 and the timer portion 3102 control the corresponding portions of the recording apparatus 310 to perform the recording operation. In the recording apparatus 310, the MPU 3101, at the time of performing the recording operation, controls the head cartridge 501, the carrier motor 511, the conveyance motor 513 and the restoring system motor 526. The head cartridge 501 is operated by a discharge heater driver 3106, while the carrier motor 511, the conveyance motor 513 and the restoring system motor 526 are operated by motor drivers 3107, 3108 and 3109. In accordance with results of detections performed by a carrier home sensor 3110, a paper sensor 3111 and a restoring system home sensor 3112, the MPU 3101 detects the position of the carriage, whether paper exists, and the cap position. The RAM 3104 has regions for storing the number MD11 of dots recorded by the monochrome recording head, the number CD11 of dots recorded by the color recording head, and data HD of the recognized current recording head. The RAM 3004 has regions for storing displayed residual quantity MDD in the monochrome recording head and displayed residual quantity CDD in the color recording head. The EEPROM 3105 has regions for storing MD11 and CD11 (hereinafter the foregoing regions are indicated by RMD11, RCD11, RHD, RMDD, RCDD, EMD11 and ECD11). The display unit 3007 displays the residual quantity of each of the monochrome recording head and the color recording head (330 and 331). The foregoing display is performed such that the number of recordable dots (HMAX) of a new recording head is, as data, previously stored in the ROM 3103; the number of dots (MD11 and CD11) by each of the current monochrome recording head and the color recording head are sequentially counted; the differences (HMAX−MD11) and (HMAX−CD11) are, as state information 321 of the recording apparatus, transmitted to the host unit 300; MDD and CDD corresponding to the differences are stored in RMDD and RCDD in the RAM 3004; and the stored MDD and CDD are displayed on the display unit 3007. In a case where an operation that changes the residual quantity is performed, for example, the discharge restoring operation is performed as well as the recording operation, the quantity, which is changed due to the foregoing operation, is converted into the number of recorded dots. The values of MD11 and CD11 are stored in the EMD11 and ECD11 of the EEPROM 3105 when the power source for the apparatus has been turned off so as to be again stored in the MD11 and RCD11 after the power source has been turned on.

Figure 12:
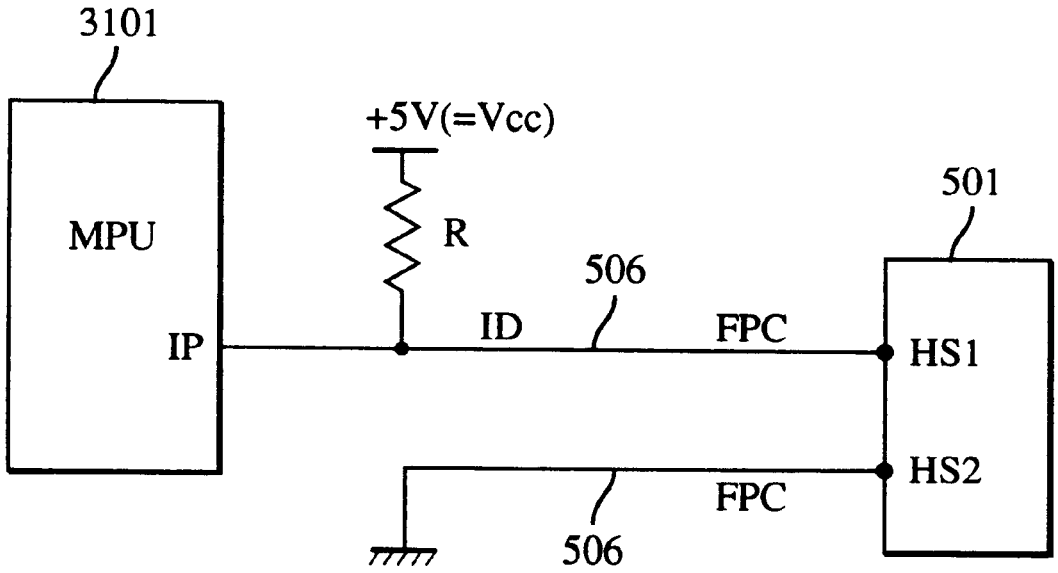
FIG. 12 is a circuit diagram showing a circuit employed in the control circuit shown in the block diagram shown in FIG. 11 and arranged to detect whether or not a head cartridge has been mounted.

FIG. 12 is a circuit diagram showing an example of the structure of a circuit for detecting as to whether or not the recording head (the head cartridge 501) has been mounted. An end of a signal ID, detecting a result of detecting whether or not the recording head has been mounted, is connected to a portion HS1 on which the head cartridge 501 will be mounted. When the head cartridge 501 has been mounted, the HS1 is electrically connected to a portion HS2 which is connected to the ground (GND) of the control portion in the body of the apparatus. Other ends of the signal ID are connected to an end of an input terminal IP, at which the MPU 3101 is able to detect the high level or the low level, and an end of a resistor R, respectively. Another end of the resistor R is connected to a power source (VCC) for the control portion in the body of the apparatus. As a result of the foregoing structure, if the head cartridge 501 has not been mounted on the carrier 502, the input terminal IP detects a high level. If the head cartridge 501 has been mounted, the input terminal IP detects a low level. Since each of the monochrome recording head and the color recording head comprises the foregoing circuit, detections of the monochrome recording head and the color recording head can be further performed (signal 3113 indicating a result of detection whether or not the monochrome recording head has been mounted and a signal 3114 indicating a result of detection whether or not the color recording head has been mounted).

Figure 13:
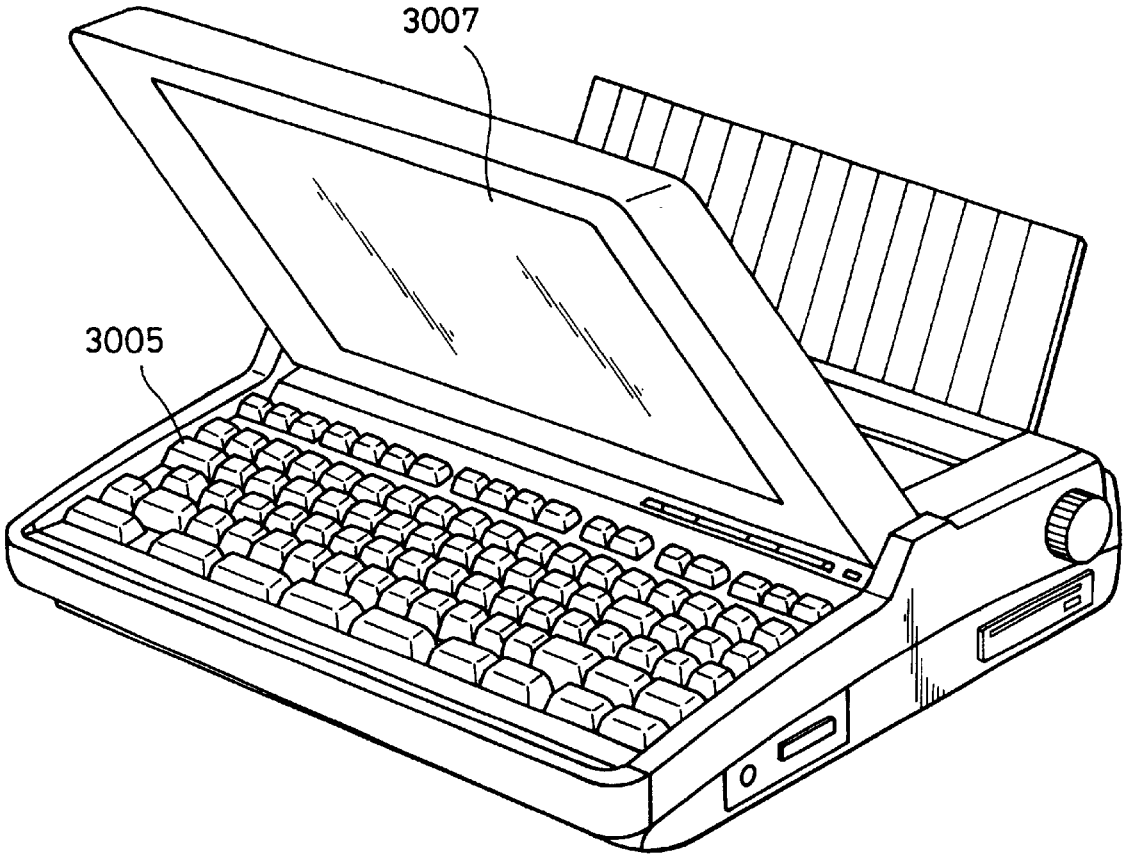
FIG. 13 is a perspective view showing the shape of an embodiment of an electronic apparatus according to the present invention and having the recording apparatus shown in FIG. 9.

FIG. 13 is a perspective view showing an example of an electronic apparatus having the ink jet recording apparatus shown in FIG. 9. Reference numeral 3005 represents an input unit for inputting information to be recorded by the recording apparatus. A display means 3007 is a display unit formed by an LCD and arranged to display inputted information and information about the recording operation. A keyboard 3005 according to this embodiment as well as serves as an instruction means for instructing change of the recording head and the recording substance supply means. The display means 3007 displays recording information, recording condition and the mode for changing the recording head and the recording substance supply means.

Figure 14:
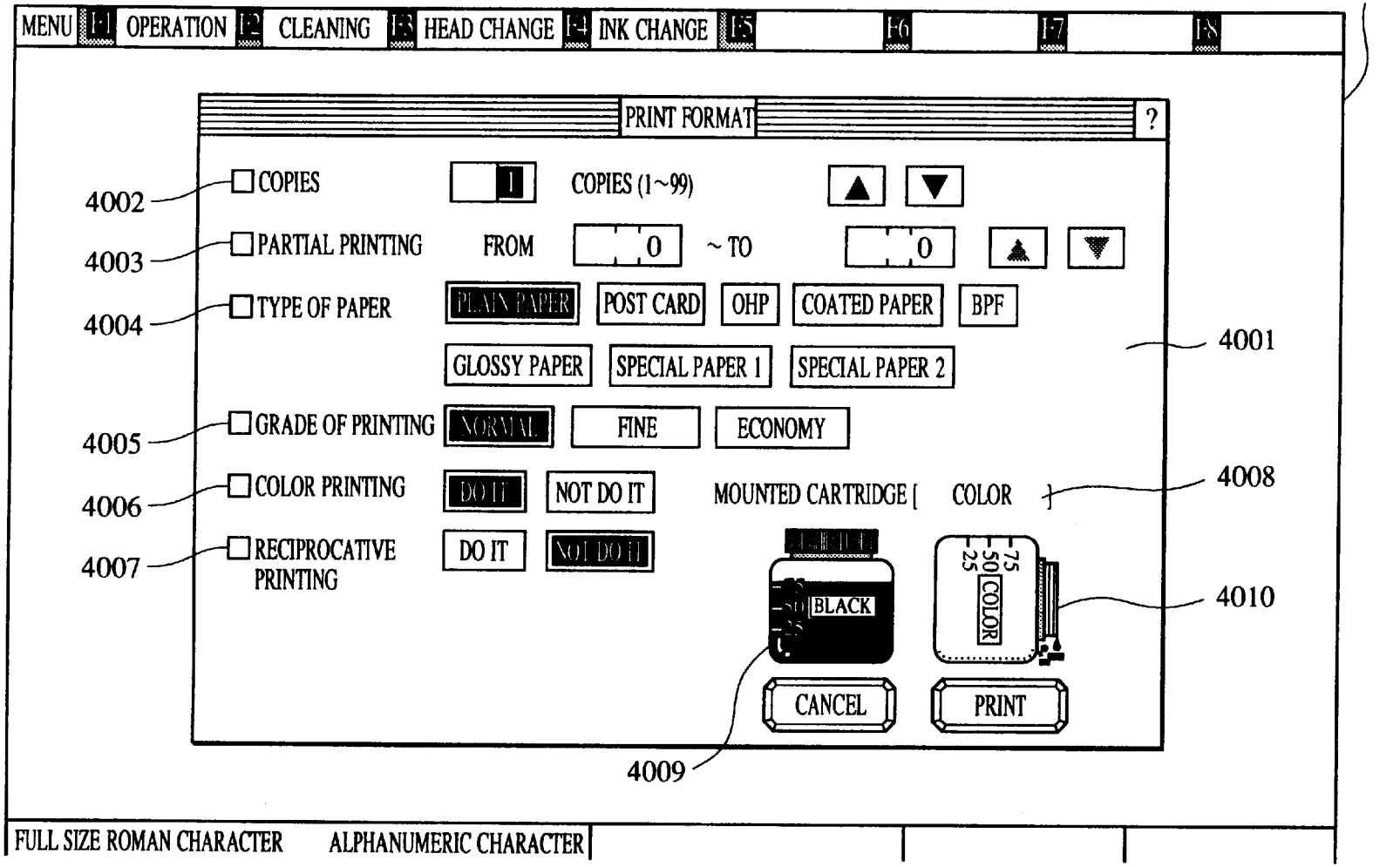
FIG. 14 shows the contents to be displayed on a display unit of the electronic apparatus shown in FIG. 13.

FIG. 14 shows the case where the information about the recording condition is displayed on the display means 3007.

A display window 4001 at the center of FIG. 14 has a structure with which a variety of conditions can be set. An item 4002 in the display window 4001 is arranged with which the number of copies is set such that it indicates the number of copies of a sequence of recording information items. The number of copies is set to one as a default. An item 4003 is used to set "partial printing" with which the pages of a plurality of pages of the information to be recorded is instructed. An item 4004 displays the "type of paper" with which the type of the recording medium for use in the recording operation is instructed. The set type of paper is invert-displayed. An item 4005 is used to set the "grade of printing" with which the method of forming the information on the recording medium is instructed. In this embodiment, "STANDARD" is a mode in which a predetermined region to be recorded is scanned once by the recording head to record information, "FINE" is a mode in which a predetermined region to be recorded is scanned by a plurality of times by the recording head to record information, and "ECONOMY" is a mode for forming a predetermined information to be recorded by thinning the same. With an item 4006, "COLOR PRINTING" is set with which whether edited information to be recorded is printed in a monochrome color or color-printed is set. An item 4007 is used to set "RECIPROCATIVE PRINTING" with which whether information is recorded by scanning in one direction, that is, forward direction (a scanning direction from the right portion to the left portion of FIG. 9) or reverse direction (a scanning direction from the left portion to the right portion of FIG. 9) or the same is recorded by both forward direction and the reverse direction is set.

An item 4008 ("MOUNTED CARTRIDGE") shown in the lower left portion of FIG. 14 indicates the type of the present head cartridge mounted, the present head cartridge being a result of detection performed by the detection circuit of the head cartridge shown in FIG. 12. Icons 4009 and 4010 indicate ink bottles respectively correspond to a monochrome ink residual quantity indicator 300 and a color ink residual quantity indicator 310 shown in FIG. 11 such that the quantities of contained inks, which are the recording substances, are indicated in accordance with the residual quantity displayed data MDD and CDD.

FIG. 14 shows display indicating that the color recording head cartridge has been mounted at present, the mounted head cartridge containing black ink in a quantity of 75% or more to not more than 100% the quantity of ink in a new head cartridge and color ink in a quantity of 0% or more to not more than 25% the quantity of ink in a new head cartridge.

Menus F1, F2, F3 and F4 shown in the upper portion of FIG. 14 indicate functions assigned to function keys F1, F2, F3 and F4 (not shown) of the keyboard 3005. The menu F1 is an instruction means for setting further detailed conditions of the recording conditions. The menu F2 is an instruction means assigned to menu "CLEANING" with which the discharge restoring operation is instructed and performed. Menus F3 and F4 are instruction means assigned to menus "HEAD CHANGE" and "INK CHANGE" with which change of the recording head and that of the ink tank serving as the recording substance supply means are instructed.

Figure 15:
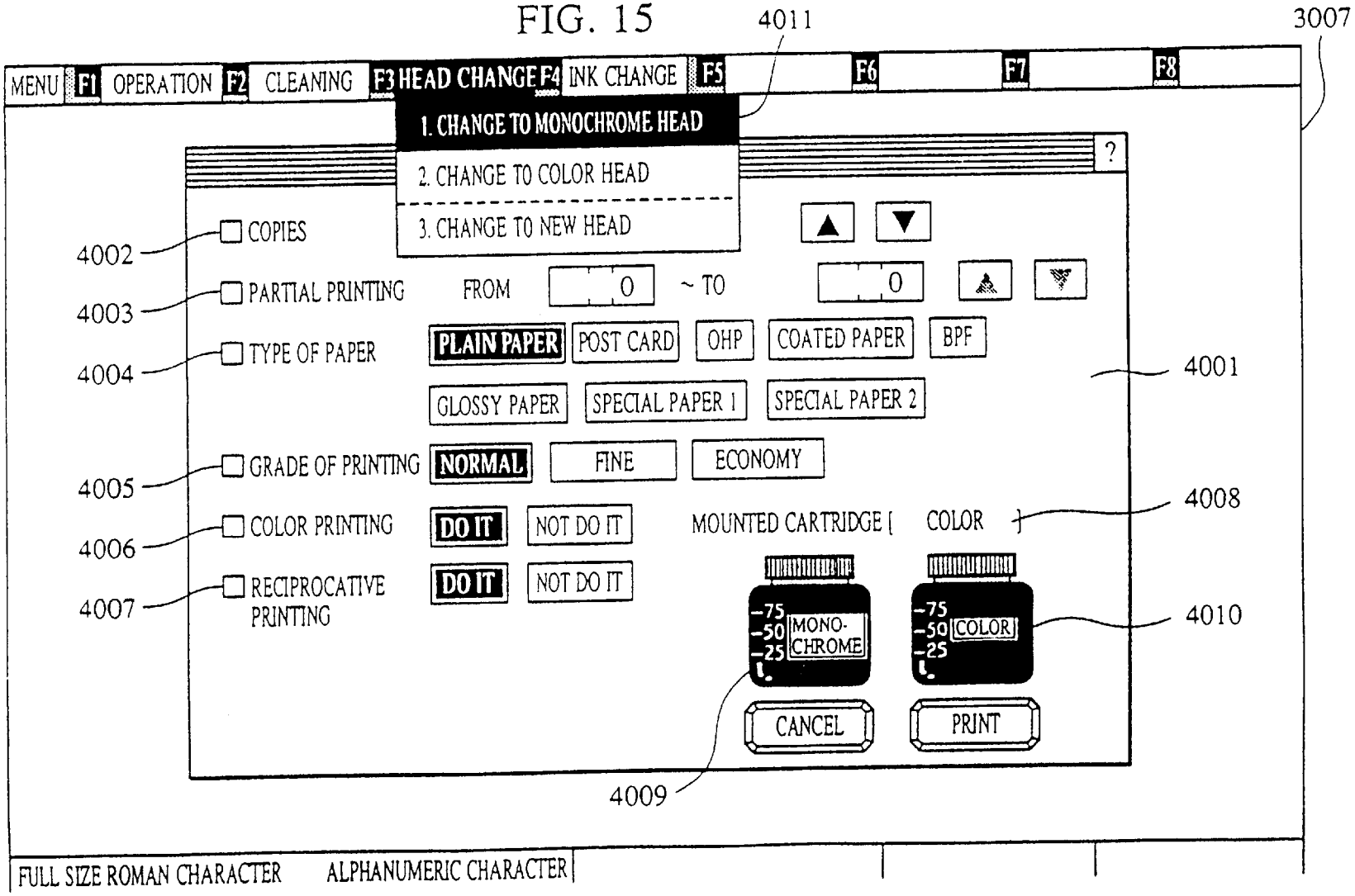
FIG. 15 shows the contents to be displayed when change of the head cartridge is selected on the display shown in FIG. 14.
Figure 16:
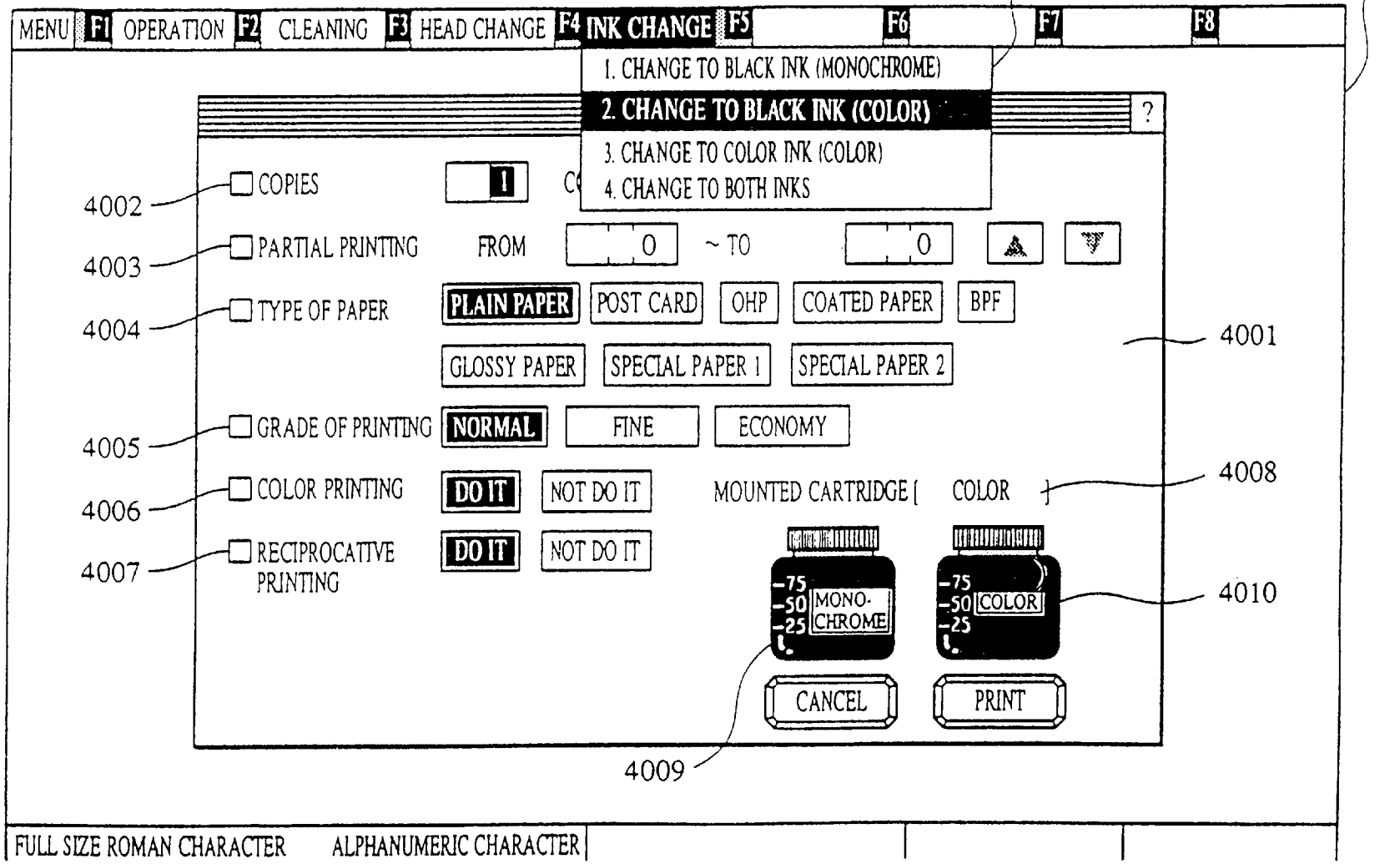
FIG. 16 shows the contents to be displayed when change of the ink tank is selected on the display shown in FIG. 14.

When the "HEAD CHANGE" assigned to the menu F3 is selected and instructed with the function key F3 provided for the keyboard 3005, further detailed contents of the change are displayed on the display means 3007 as shown in FIG. 15. As shown in FIG. 15, the menu F3 is selected so that the "HEAD CHANGE" assigned to the menu F3 is inversely displayed and further detailed menu is displayed as a pull down menu 4011. By employing the pull down menu, a required menu can be displayed as the need arises and menu selection can be performed easily. Three items are displayed, which are "1. CHANGE TO MONOCHROME HEAD", "2. CHANGE TO COLOR HEAD" and "3. CHANGE TO NEW HEAD". The "CHANGE TO MONOCHROME HEAD" indicates change of the current color head to the monochrome head, "CHANGE TO NEW HEAD" indicates change of the current color head to a new monochrome head or a new color head. Since the color head is mounted on the recording apparatus at present, the change from the present color head to a color head, which is not a new head, is not performed. Therefore, the menu "2. CHANGE TO COLOR HEAD" is hidden to prevent selection and instruction. FIG. 15 shows a state where the menu "2. CHANGE TO COLOR HEAD" is displayed in a thin color to prevent the menu from being selected and instructed. The method of indicating the item that cannot be selected is not limited to that employed in this embodiment. For example, a message that selection and instruction cannot be performed may be shown when the selecting operation has been performed. In the case where a monochrome head has been mounted, change from the monochrome head to a monochrome head, which is not a new head, is not performed. Therefore, the change to the monochrome head is prevented by hiding the display. Also the "INK CHANGE" is selected by the function key F4 provided for the keyboard 3005. The detailed contents of the change shown in FIG. 16 are displayed in the pull down menu 4012. The displayed contents of the change concern the head mounted at present and are "CHANGE TO BLACK INK (COLOR) (the ink tank in the color head is changed to a black ink tank), "CHANGE TO COLOR INK", the ink tank in the color head is changed to a color ink tank, and changes to black and color ink tanks. The display of change of a black ink tank in the monochrome head is hidden. In the case where the monochrome head has been mounted, the menu F4 displays only the change of the ink tank in the monochrome head to a black ink and the other contents are hidden.

Figures 17, 17A:
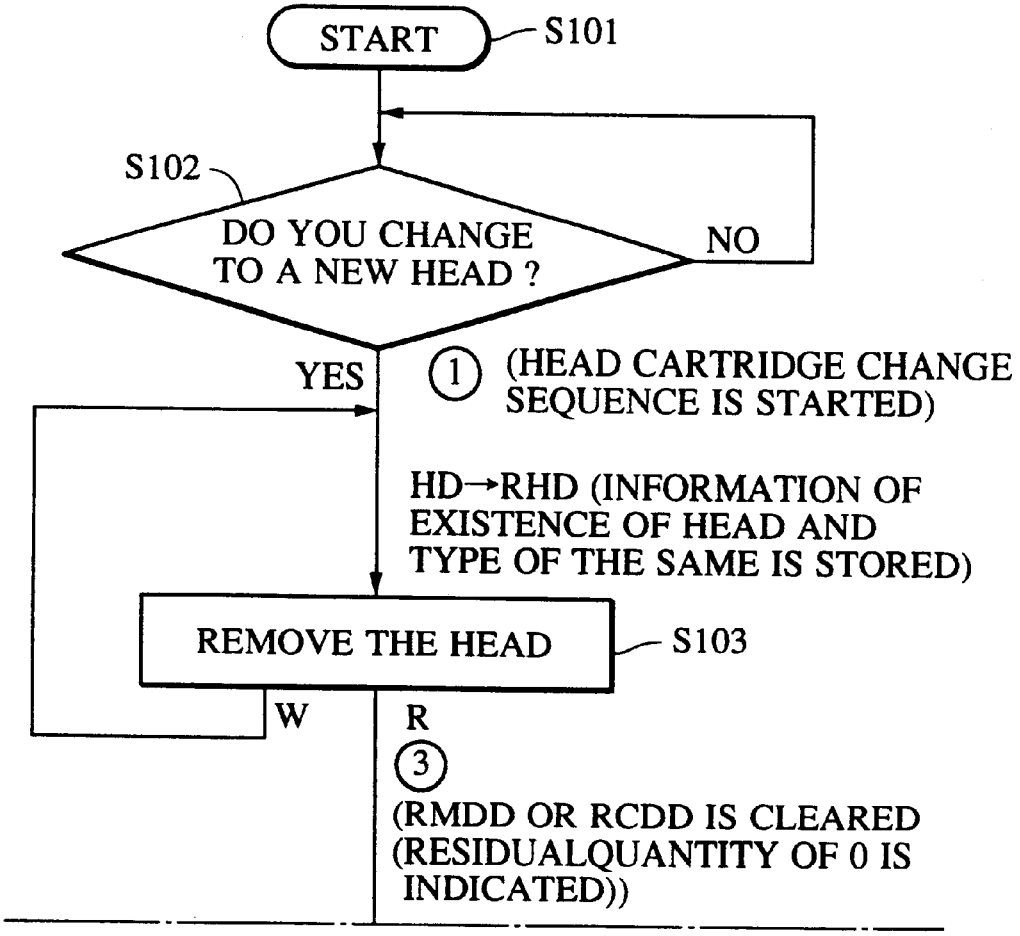
FIG. 17, which is comprised of FIGS. 17A and 17B, is a flow chart showing the operation of controlling change of the head cartridge according to the embodiment of the present invention.
Figure 17B:
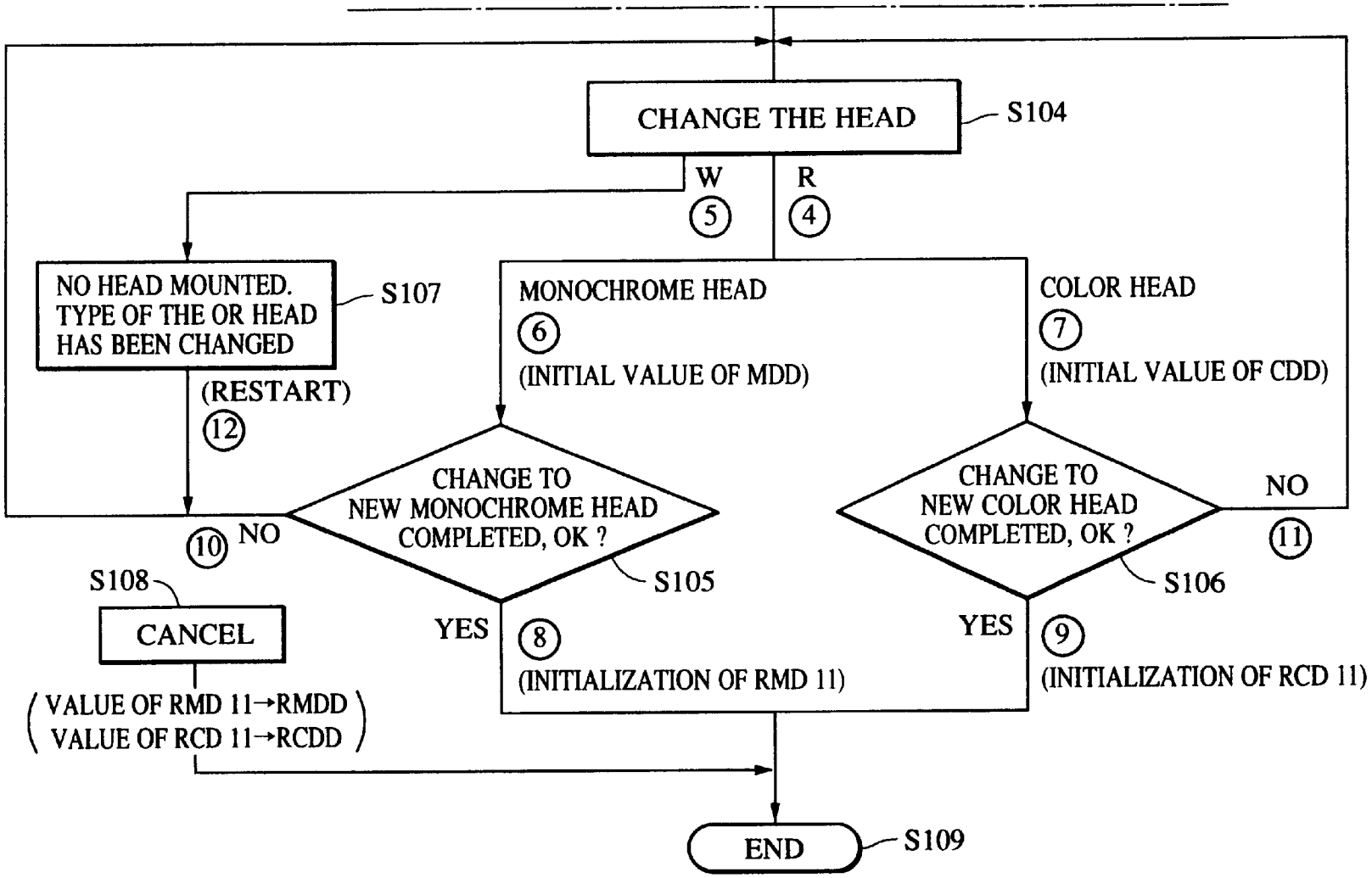

Referring to FIG. 17, the method of changing the head cartridge and a control sequence for displaying the residual quantity of ink according to this embodiment will now be described.

Referring to FIG. 17, symbol R indicates normal completion of the operation, and symbol W indicates abnormal completion or incompletion of the operation. The description will be performed hereinafter about a case where change to a new color recording head is performed in a state where a monochrome head cartridge has been mounted on the recording apparatus although change to a new monochrome head cartridge was attempted. However, similar control may be adapted to the reverse case.

If the recording condition of the head cartridge 1 has deteriorated, that is, if a state not suitable to recording has been realized (for example, if a discharged ink droplet cannot reach a desired position on the recording medium), a user selects "CLEANING" displayed in the upper portion of the display means 3007 so that the cleaning operation which is the discharge restoring process is performed. Selection of the menu F3 can be performed by selecting and depressing the function key F3 (not shown) of the keyboard 3005. If the head cartridge is not suitable to performing the recording operation even after the foregoing operation has been performed, change of the head cartridge to a new head cartridge is permitted in a case where the user has determined that the life of the head cartridge has been depleted.

When change to a new head cartridge is performed, the key F3 is used in this embodiment to instruct the head change and "CHANGE TO NEW HEAD" in the pull down menu 4011 shown in FIG. 15 is selected. If "CHANGE TO NEW HEAD" in the pull down menu 4011 shown in FIG. 15 is selected, a determination is performed in step S102 that change to a new head has been instructed. Then, the operation proceeds to step S103. Thus, the head cartridge change sequence starts (1) so that information HD indicating whether or not a head cartridge has been mounted and the type of the mounted head cartridge is detected by the circuit shown in FIG. 12 (in the foregoing case a monochrome head cartridge being mounted is detected); and the information HD is stored in the RHD. In step S103 a message of removing the head cartridge is displayed. If removable of the head cartridge has been detected by the foregoing circuit, either of RMDD or RCDD, that corresponds to the foregoing case, is initialized and the indication of the residual quantity, that is, the contents of indication are cleared to zero (in this case RMDD is cleared). In step S104 a message that the head cartridge must be changed is displayed. If no head cartridge being mounted has been detected at the start (1) of the head cartridge change sequence, step S103 is omitted but information about this has been stored in the RHD when the recording head has been removed.

When the type of the mounted head cartridge has been detected by the circuit shown in FIG. 12 (if a color head mounted unintentionally is detected), the indication of the residual quantity, that is, the contents to be indicated are, as CCD having the value HMAX, stored in the RCDD to correspond to mounting of the color head cartridge (in the foregoing case, the MAX value is stored in the RCDD as shown in (6) of FIG. 17). The value stored in the RMD11 and RCD11, that is, the number of recorded dots (the count) is not initialized but is maintained. After the display of the residual quantity, that is, the contents to be indicated have been changed to MAX, a message indicating completion of the head cartridge is displayed in step S106 to cause the user to confirm this.

If the user confirms erroneous mounting of the color cartridge in accordance with the display of the type of the mounted head cartridge and the residual quantity of the color head cartridge indicating the MAX value in step S106 and, therefore, the user performs a predetermined input, the operation returns to step S104.

If a correct head cartridge has been mounted due to the foregoing process and YES has been selected and inputted in step S105 or S106, the value of the RMD11 or that of RCD11 is thus initialized (in the foregoing case, the value of the RMD 11 is initialized as indicated by (7) of FIG. 17).

To cancel the operation, "CANCEL" is selected so that the values of the RMD11 and RCD11 are again stored in the RMDD and RCDD in accordance with the information HD at the start of the head cartridge change sequence. As a result of the foregoing procedure, the display of the residual quantity, that is, the contents to be indicated, can be restored to the display of the residual quantity (the contents to be indicated) in the state before the head cartridge is changed.

Although the foregoing description has been performed about the case where change is performed to a new head cartridge of the same type as that of the head cartridge, which has been mounted on the recording apparatus, a similar operation is performed in a case where the head cartridge mounted on the recording apparatus is changed to a new head cartridge of a different type (for example, change from a monochrome head cartridge to a color head cartridge). In the case where change to a head cartridge of a different type is performed, "CHANGE TO MONOCHROME HEAD" or "CHANGE TO COLOR HEAD" shown in FIG. 15 is selected by using the key F3. The residual quantity of ink is displayed when the head cartridge has been changed to a color head cartridge such that the difference (HMAX−CD11) is transmitted to the host unit as the state information 321 of the recording apparatus, the difference (HMAX−CD11) being the difference between the number of recorded dots (CD11) stored in the RAM 3104 or the EEPROM 3105 when the color head cartridge has been mounted and used and the number of recordable dots (HMAX). The foregoing value CDD is stored in RCDD of the RAM 304; and in accordance with the value CDD, the residual quantity is displayed on the display unit 3007.

When the ink tank changeably mounted on the head cartridge is changed, selection of "INK CHANGE" from the menu F4 enables a similar instruction to be performed to change the ink tank.

The initial quantity of ink is sometimes different between the case where change to a new ink tank is performed to change ink and the case where change to a new head cartridge is performed to change the head. When only the ink tank is changed, the change can be performed in a state where the tank is filled with ink. New heads are sometimes shipped from a manufacturing plant after the state of discharge from the head has been tested. Therefore, the residual quantity of ink in a head mounted newly is smaller than the residual quantity of ink in a new ink tank. As a result, it is preferable that the initial values of the residual quantity of inks after the changes have been performed be changed between the two cases.

As described above, this embodiment has the structure such that the change mode is displayed on the display unit 3007; instruction means corresponding to the change modes to be displayed are provided for the keys of the keyboard 3005; and the change is instructed by the instruction means. Therefore, an error in the change can be prevented, and the control of the display of the residual quantity of ink can be performed accurately.

The foregoing embodiment has the structure such that the residual quantity of ink is displayed in accordance with the change instruction issued from the instruction means, that is, the contents to be indicated are changed (in the foregoing embodiment, the display of the residual quantity is changed to the MAX value when the head is changed to a new head). Then, the description will be made about a structure in which the head cartridge is subjected to a discharge restoring process in accordance with an instruction to change the head cartridge issued from the instruction means.

Figure 18:
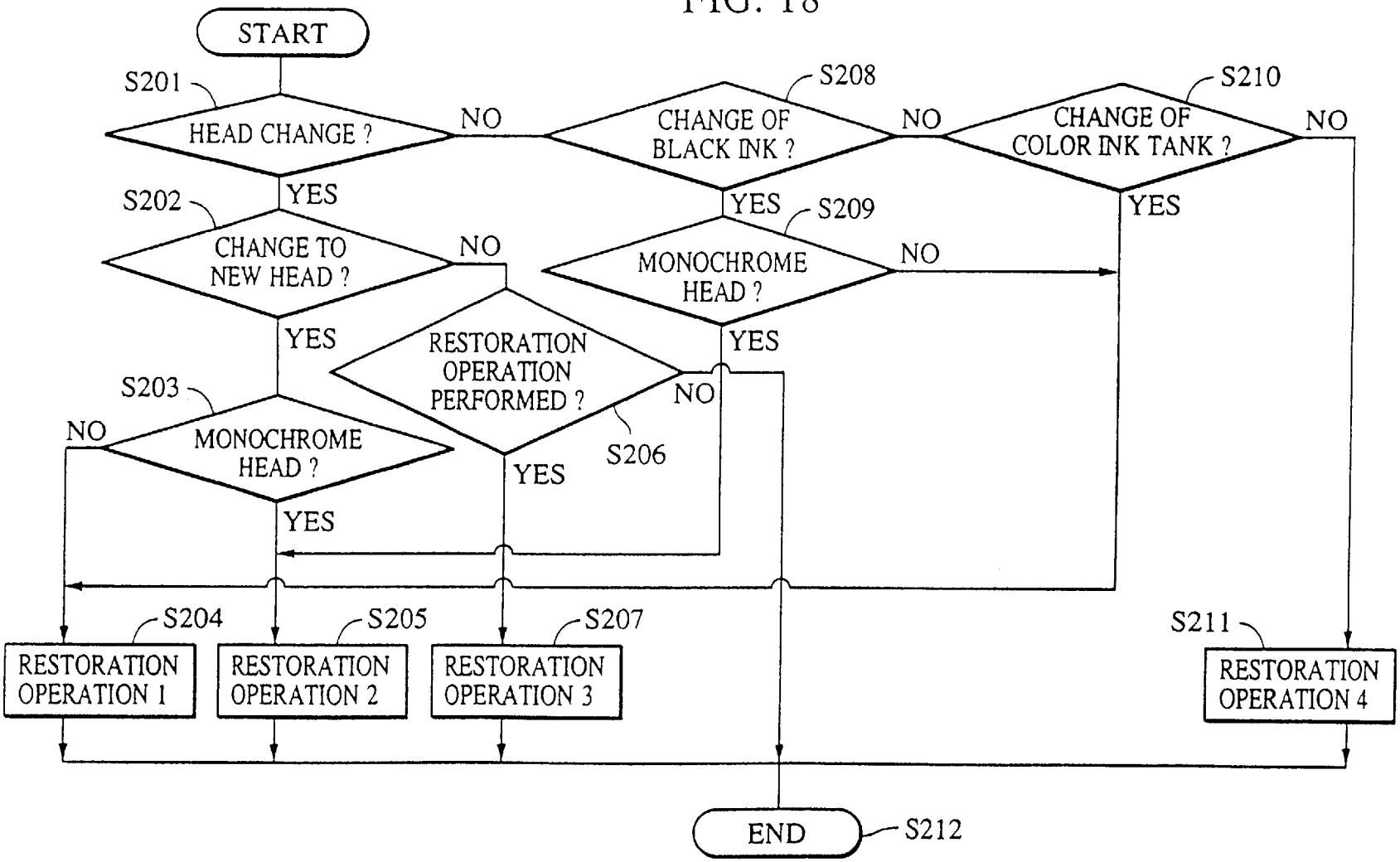
FIG. 18 is a flow chart of the operation of controlling the recording apparatus according to the embodiment of the present invention after the change has been performed.

FIG. 18 is a flow chart showing a process in which the discharge restoring operation is performed in accordance with the mode for changing the head cartridge or the ink tank. Discharge restoring operations 1 to 5 of the discharge restoring process will be described later, and the flow to the restoring operation will now be described.

Whether or not the change is the head change or the change of the ink tank is determined in step S201. If a determination has been made in step S201 that the head has been changed, whether or not the operation is to change the head cartridge to a new one is determined in step S202. If a determination has been performed in step S202 that the change to a new head has been carried out, the type of the head cartridge is determined in step S203. If a determination has been performed in step S203 that a color head cartridge has been mounted after the change, the operation proceeds to step S204 so that the restoring operation 1 is performed. If a determination has been performed in step S203 that the change to a monochrome head has been carried out, the operation proceeds to step S205 so that the restoring operation 2 is performed.

Correspondence to each instruction means displayed on the display unit 3007 is established such that the determinations in steps S201 and S202 are determined in accordance with the result of instruction of the menu corresponding to the function key F3; and the determination of the type of the head in step S203 is performed in accordance with the information HD, which is detected by the detection circuit shown in FIG. 12.

If a determination has been performed in step S202 that change to a head, which is not a new head, is performed (if change to a head of a different type is performed), whether or not the restoring operation is performed is determined in step S206. If the foregoing operation is performed, the operation proceeds to step S207 so that the restoring operation 3 is performed.

The determination in step S206 is performed in accordance with a lapse of time from the moment at which the head mounted after the change has been subjected to the discharge restoring process. In this embodiment, the recording operation is performed if 72 or longer hours are elapsed from the previous discharge restoring operation. The time, at which the discharge restoring operation has been performed, is stored in the RAM 3104 and the EEPROM 3105 whenever the discharge restoring operation is performed. The stored time and the time, at which the changing operation has been completed, are used to calculate the elapsed time. In this embodiment, the time is measured by a timer 3002. In this embodiment, whether or not the recording operation is performed in accordance with whether or not 72 hours have been elapsed from the removal from the recording apparatus. The reason for this is that rise in the viscosity of the ink and the quantity of dust and the like adhered to the surface of the discharge ports of the head cartridge are allowable and, therefore, the discharge restoring operation is not required. If the discharge restoring operation is always performed, the quantity of consumed ink becomes too large. Therefore, the excessive discharge restoring operation must be prevented to reduce the running cost. Although the determination is performed depending upon whether or not 72 hours have elapsed in this embodiment, the contents of the discharge restoring operation may be divided into a plurality of levels which are arranged to be performed in accordance with the time lapse.

If a determination has been performed in step S201 that change except the head change (change of the ink tank) is performed, the operation proceeds to step S208 so that whether or not the change of a black ink tank is performed is determined. If the change of the black ink tank is performed, whether or not the ink tank is a tank for a monochrome head cartridge is determined in step S209. If the tank is that for the monochrome head cartridge, the recording operation 2 is performed in step S205. If a determination has been performed that the head cartridge is not the monochrome head cartridge, the operation proceeds to step S204 so that the restoration operation 1 is performed. If a determination is performed in step S208 that the change is not change of the black ink tank, a determination is performed in step S210 as to whether or not the change is change of the color tank. If the change is change of the color ink tank, the restoration operation 1 is performed simultaneously with step S204. If a determination is performed in step S210 that the change is not change of the color ink tank, a determination is performed in this embodiment that the change is an operation of changing the color ink tank and the monochrome ink tank. Then, the operation proceeds to step S211 so that the restoration operation 4 is performed.

If the head is changed, if the ink tank is changed, if change to a monochrome ink or a color ink is performed or if change to a new head is performed, an appropriate restoration operation is performed.

Figure 20:
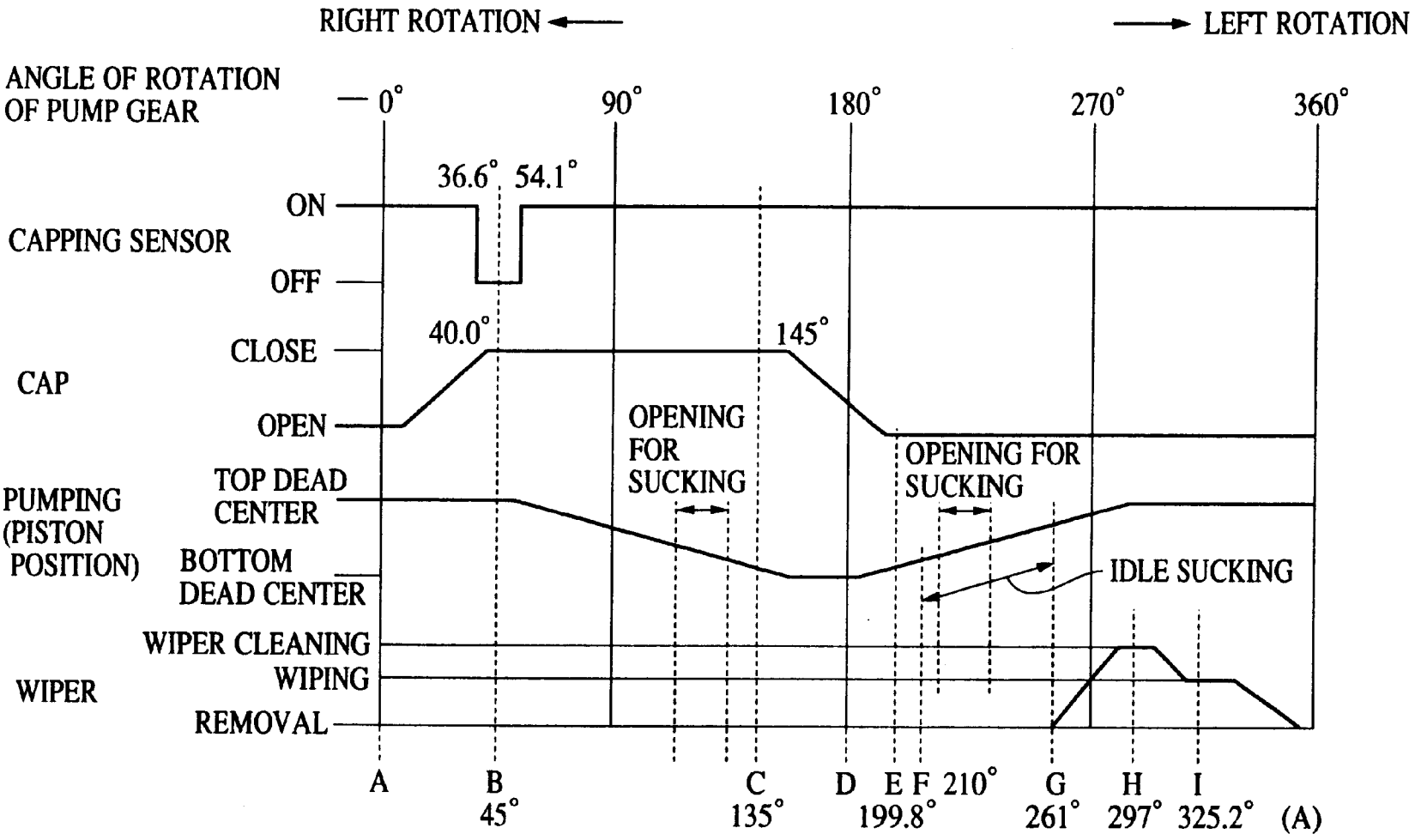
FIG. 20 is a view of explanatory showing timing of the discharge restoring operation.

Referring to FIGS. 19 and 20, the discharge restoring process will now be described. FIG. 19 shows the flow of the discharge restoring operation. FIG. 20 is a diagram showing a state of rotation of a pump gear of a restoring system unit for performing the discharge restoring process. As shown in FIG. 9, the restoring system unit comprises the cap 522 opposing the surface of the head cartridge 501 in which the ink discharge ports are formed; the pump 523 for generating sucking force to suck ink received in the cap 522; the waste ink tank 524 for storing ink sucked by the pump 523 and unsuitable to the recording operation; the wiper 525 for wiping the surfaces of the discharge ports; and the cam unit 527 for receiving transmitted drive force to move the pump 523, the cap 522 and the wiper 525. The operation of the restoring system unit is divided into a capping operation, a wiping operation and a pumping operation.

The capping operation is an operation using the cap 522 to automatically cap the head cartridge 501 at a reference position (at a position shown in FIG. 20, at which the capping sensor is turned off, hereinafter called a "home position") in order to prevent ink in the nozzle from being dried and adhesion of dust and paper dust. The foregoing operation is automatically performed when the power source for the word process has been turned off or when a predetermined time has elapsed in a cap opened state (no capping state).

The wiping operation is an operation using the wiper 525 projecting toward the head cartridge 501 and supported movably at the position, at which wiping is performed during the movement of the carrier 503, and the position, at which the wiper 525 is moved away from the surface in which the discharge ports are formed, in order to wipe dust and paper dust adhered to the discharge ports of the head cartridge 501. The wiping operation is performed when the power source for the recording apparatus is turned off, in a cap opened state, before the cap closed state (before the capping state), before printing each page, immediately after the capping operation, and after a predetermined number of dots have been recorded and after a predetermined time has passed. In particular, small ink droplets adhere to the surfaces of the discharge ports after the restoring operation, in which discharge of ink is performed, is performed. To prevent deterioration in the discharging condition caused from this, the wiping operation is performed after the restoring operation in which discharge of ink is performed so that the restoring operation is reliably completed.

Moreover, a process (previous discharge) is performed in which the cap is allowed to face the surface in which the discharge ports are formed, and energy generating devices disposed at the discharge ports to discharge ink are operated so that ink is discharged from the nozzle to remove factors causing the discharge to become defective, such as bubbles, dust and ink, the viscosity of which has been raised excessively to be used in the recording operation. Another process is performed in which ink is forcibly discharged through the discharge ports by using a sucking means, such as the pump 523, to remove the factors causing the discharge to become defective.

In the restoring system in the capping state at the home position as shown in FIG. 19, the piston is operated so that the pumping operation is performed (operation (1)). In the foregoing state, the operation is paused for 3 seconds to sufficiently suck ink (operation (2)). Then, all nozzles are caused to discharge ink previously in a state where the cap is opened (operation (3)). Then, idle sucking is performed four times to discharge ink filled in the pump (operation (4)). Then, the head cartridge 501 is moved to the position, at which the wiper is turned on, and wiping is performed (operation (5)). Then, the wiper cleaning is performed (operation (6)), and the head cartridge 501 is returned to the capping position to cap the discharge ports (operation (7)). The foregoing wiper cleaning is an operation in which the carrier is moved in a state where the wiper is in contact with a cleaner member (not shown) disposed to oppose the wiper 525 and provided for the carriage 503 in such a manner that the cleaner member is able to be in contact with the wiper 525 in order to clean the wiper 525.

The restoring operations 1, 2, 3 and 4 shown in FIG. 18 will now be described with reference to FIG. 21.

The number of ink sucking operations corresponding to the restoring operation shown in FIG. 21 is achieved by repeating the sequence of discharge restoring operations shown in FIG. 19 by a predetermined number of times. The number of the previous discharging operations is achieved by performing the discharging operations to be performed in (3) shown in FIG. 19 by the number of times shown in FIG. 21. The reason why a large number of ink sucking operations and that of previous discharge operations are performed in the restoring operation 1 and the restoring operation 4 as compared with other restoring operations is that the head cartridge to be subjected to the foregoing processes is the color head cartridge and the color ink tank. Since the ink passage in the color head cartridge according to this embodiment is longer than that in the monochrome head cartridge, ink must be sucked in a large quantity. The reason why the number of previous discharging operations is large is that mixture of ink in another color with the nozzle for discharging color ink must be prevented. The number of ink sucking operations is set to 1, which is the smallest number, because ink must be sucked in a small quantity when a restoring operation is performed due to a lapse of time.

The foregoing restoring operations are not limited to the those according to this embodiment. As a matter of course, an appropriate arrangement to be suitable to the structure of the head cartridge and the like may be employed. It is preferable that the restoring operation 3 to be performed in step S207 shown in FIG. 18 is arranged to be different in the case where the change of the head to a different head between the case where change to a monochrome head cartridge is performed and the case where change to the color head cartridge is performed.

Another example of the flow chart shown in FIG. 18 will now be described.

Figure 22:
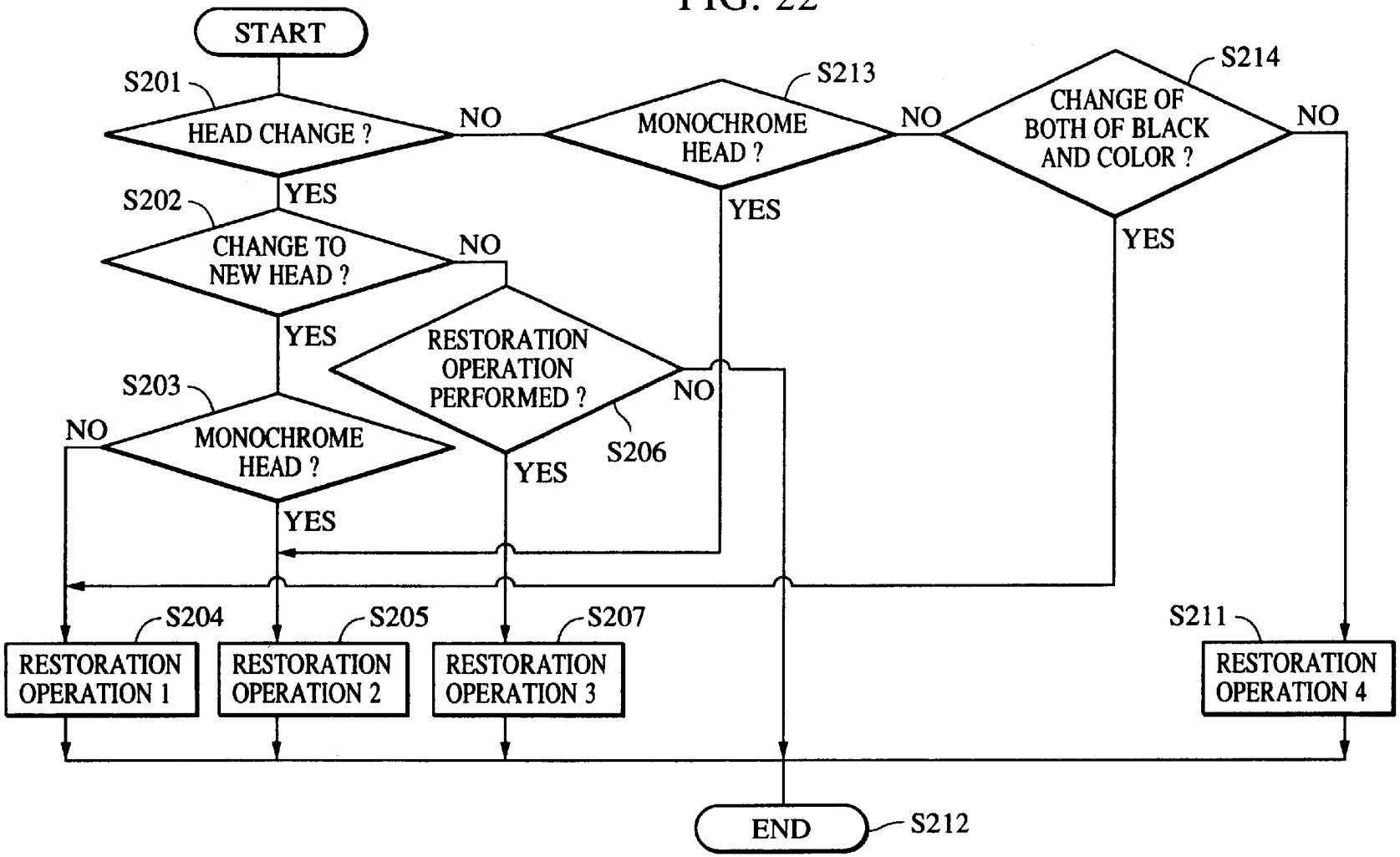
FIG. 22 is a flow chart of the operation for controlling the recording apparatus according to another embodiment of the present invention after the change has been performed.

FIG. 22 shows an example of the flow chart shown in FIG. 18. The same processes as those shown in FIG. 18 are given the same step numbers.

In the flow chart shown in FIG. 22, if a determination has been performed in step S201 that the change is change of the ink tank, the type of the mounted head is determined in step S213 in place of determining the type of the tank to be changed. In the flow chart shown in FIG. 18, if the determination has been performed that the change of the ink tank is performed, the type of the ink tank to be changed is determined. In the foregoing viewpoint, the flow chart shown in FIG. 18 is different from that shown in FIG. 22.

The determination of the head in step S213 is performed in accordance with the information HD detected by the detection circuit shown in FIG. 12. Since the type of the head to be mounted can be detected without an instruction from a user, the restoring operation can be set such that the instruction from the user is simplified if a monochrome head will be mounted. As a result, the process required to the moment at which the restoring operation is determined in the case where the ink tank is changed can be achieved by a smaller number of steps as compared with the flow chart shown in FIG. 18. Thus, the instructions required for the user can be decreased.

As described above, when a recording head or a recording substance supply means of a recording apparatus is changed, the change can accurately be instructed and control of the recording apparatus after it has been changed can accurately be performed. Since control of the recording apparatus after the change can accurately be performed, wasteful consumption of the recording substance can be prevented if the recording substance in the recording substance supply means is used in an operation except the recording operation to be performed after the change has been performed.

Although the electronic apparatus including the recording apparatus has been described, the present invention may be adapted to an electronic apparatus having a structure comprising a display unit, an information processing apparatus for editing and processing information to be recorded, and a recording apparatus in such a manner that they are individually disposed and they are connected to one another through interface cables.

Although the ink jet recording apparatus has been described, the present invention may be adapted to an electrophotographic copying machine or a laser printer of a type using toner as the recording substance and the cartridge for supplying the recording substances is changeably provided.

The ink jet recording apparatus according to the present invention is not limited to an image output unit of an information processing apparatus, such as a computer. For example, the present invention may be adapted to a copying machine combined with an image reader or an apparatus in the form of a facsimile apparatus having a transmitting function and a receiving function.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. An ink jet recording apparatus comprising:

a movable carriage for carrying, thereon, a recording head selected from a plurality of different types of recording heads for discharging ink to record characters and images and an ink tank selected from a plurality of different types of ink tanks for storing ink to be supplied to said recording head, said recording head and said ink tank being changeable;

restoring means for restoring said recording head;

detection means for determining one of the type of said recording head and the type of said ink tank; and control means for causing said restoring means to restore said recording head in a case where said detection means has detected one of a change of said recording head and a change of said ink tank on said movable carriage to a same type of said recording head or said ink tank, wherein said control means inhibits said restoring means from restoring said recording head in a case where said detection means has detected one of a change of said recording head and a change of said ink tank to a different type of said recording head or said ink tank.

2. An ink jet recording apparatus according to claim 1, wherein the types of said recording heads or said ink tanks are monochrome recording heads or ink tanks and color recording heads or ink tanks.

3. An ink jet recording apparatus according to claim 1, wherein said recording head and said ink tank are made to be mutually separable and integrally mounted on said movable carriage.

4. An ink jet recording apparatus according to claim 1, wherein said restoring means includes a cap for covering ink discharge ports formed in said recording head and a suction pump for sucking ink from the ink discharge ports for restoring said recording head when said cap covers the discharge ports.

5. An ink jet recording apparatus according to claim 1, wherein said recording head has energy generating means for generating energy for discharging ink.

6. An ink jet recording apparatus according to claim 5, wherein said energy generating means are electrothermal energy converters for generating heat energy as said energy.

7. A recording apparatus having a recording head and recording substance supply means for supplying recording substances to said recording head such that at least one of said recording head and said recording substance supply means can be changed in a plurality of change modes, said recording apparatus comprising:

display means for displaying the plurality of change modes concerning change of at least one of said recording head and said recording substance supply means;

instruction means for selecting a desired change mode from the plurality of change modes displayed on said display means; and control means for controlling said recording apparatus in accordance with an instruction issued by said instruction means.

8. A recording apparatus according to claim 7, wherein said display means displays the plurality of change modes by characters or image information.

9. A recording apparatus according to claim 7, wherein one of the plurality of change modes to be displayed on said display means comprises a change mode from a recording head, which is being used, to a recording head, which has not been used.

10. A recording apparatus according to claim 7, wherein one of the plurality of change modes to be displayed on said display means comprises a change mode from recording substance supply means, which is being used, to recording substance supply means, which has not been used.

11. A recording apparatus according to claim 7, wherein said display means is for displaying information to be recorded by said recording apparatus or for displaying information about a recording operation to be performed by said recording apparatus.

12. A recording apparatus according to claim 7, wherein said recording substance supply means is changeably provided for said recording head.

13. A recording apparatus according to claim 7, wherein said recording substance comprises ink and said recording head is for recording characters and images on a recording medium by discharging the ink.

14. A recording apparatus according to claim 13 further comprising:

discharge restoring means for restoring ink discharge from said recording head, wherein said control means controls said discharge restoring means in accordance with an instruction issued by said instruction means.

15. A recording apparatus according to claim 13, wherein said recording head has discharge means using heat energy to generate bubbles in the ink so that the ink is discharged.

16. A recording apparatus according to claim 7, wherein said recording apparatus is an ink jet recording apparatus for recording characters and images by discharging ink supplied from said recording substance supply means, said recording apparatus further comprising:

detection means for detecting a quantity of ink stored in said recording substance supply means mounted on said recording apparatus; and indicating means for indicating the quantity of the ink stored in said recording substance supply means, wherein said control means changes indications to be indicated by said indicating means in accordance with an instruction issued by said instruction means.

17. An electronic apparatus electrically connected to a recording apparatus having a recording head and recording substance supply means for supplying recording substances to said recording head such that at least one of said recording head and said recording substance supply means can be changed in a plurality of change modes, said electronic apparatus comprising:

display means for displaying the plurality of change modes concerning change of at least one of said recording head and said recording substance supply means;

instruction means for selecting a desired change mode from the plurality of change modes displayed on said display means; and control means for controlling the recording apparatus in accordance with an instruction issued by said instruction means.

18. An electronic apparatus according to claim 17, wherein said display means displays the plurality of change modes by characters or image information.

19. An electronic apparatus according to claim 17, wherein one of the plurality of change modes to be displayed on said display means comprises a change mode from a recording head, which is being used, to a recording head, which has not been used.

20. An electronic apparatus according to claim 17, wherein one of the plurality of change modes to be displayed on said display means comprises a change mode from recording substance supply means, which is being used, to recording substance supply means, which has not been used.

21. An electronic apparatus according to claim 17, wherein said display means is for displaying information to be recorded by said recording apparatus or for displaying information about a recording operation to be performed by said recording apparatus.

22. An electronic apparatus according to claim 17, wherein said recording substance supply means is changeably provided for said recording head.

23. An electronic apparatus according to claim 17, wherein said recording substance is ink and said recording head is an ink jet recording head for recording characters and images on a recording medium by discharging said recording substances.

24. An electronic apparatus according to claim 23, wherein said recording apparatus further comprises discharge restoring means for restoring ink discharge from said recording head, and said control means controls said discharge restoring means in accordance with an instruction issued by said instruction means.

25. An electronic apparatus according to claim 23, wherein said recording head has discharge means using heat energy to generate bubbles in the ink so that the ink is discharged.

26. An electronic apparatus according to claim 17, wherein said recording apparatus is an ink jet recording apparatus for recording characters and images by discharging ink supplied from said recording substance supply means, said recording apparatus further comprising:

detection means for detecting a quantity of ink stored in said recording substance supply means mounted on said recording apparatus; and indicating means for indicating the quantity of the ink stored in said recording substance supply means, wherein said control means changes indications to be indicated by said indicating means in accordance with an instruction issued by said instruction means.

27. A change control method for a recording apparatus having a recording head and recording substance supply means for supplying recording substances to said recording head such that at least one of said recording head and said recording substance supply means can be changed, said change control method comprising the steps of:

displaying a plurality of change modes concerning one of change of said recording head and change of said recording substance supply means;

selecting a change mode from the plurality of change modes displayed for changing one of said recording head and said recording substance supply means; and controlling said recording apparatus in accordance with the change mode selected in said selecting step.

28. A change control method according to claim 27, wherein one of the plurality of change modes to be displayed in said displaying step comprises a change mode from a recording head, which is being used by the recording apparatus, to a recording head, which has not been used.

29. A change control method according to claim 27, wherein one of the plurality of change modes to be displayed in said displaying step comprises a change mode from recording substance supply means, which is being used by the recording apparatus, to recording substance supply means, which has not been used.

30. A change control method according to claim 27, wherein said displaying step is for displaying information to be recorded by said recording apparatus or information about a recording operation to be performed by said recording apparatus.

31. A change control method according to claim 27, wherein said recording substance supply means is changeably provided for said recording head.

32. A change control method according to claim 27, wherein said recording head is an ink jet recording head for recording characters and/or images on a recording medium by discharging said recording substances.

33. A change control method according to claim 32 further comprising a discharge restoring step for restoring ink discharge from said recording head, wherein said control step is for controlling said discharge restoring step in accordance with a result of selection performed in said selecting step.

34. A change control method according to claim 32, wherein said recording head has discharge means using heat energy to generate bubbles in the ink so that the ink is discharged.

35. A change control method according to claim 27, wherein said recording apparatus is an ink jet recording apparatus for recording characters and images by discharging ink supplied from said recording substance supply means, and said change control method further comprises the steps of:

detecting a quantity of ink stored in said recording substance supply means mounted on said recording apparatus; and indicating the quantity of the ink stored in said recording substance supply means, wherein said control step is for changing indications to be indicated in said indicating step in accordance with a result of the selection performed in said selecting step.

36. A memory medium embodying a program of a change control method for a recording apparatus having a recording head and recording substance supply means for supplying recording substances to said recording head such that at least one of said recording head and said recording substance supply means can be changed, said program for executing said change control method comprising the steps of:

displaying a plurality of change modes concerning one of change of said recording head and change of said recording substance supply means;

selecting a change mode from the plurality of change modes displayed for changing one of said recording head and said recording substance supply means; and controlling said recording apparatus in accordance with the change mode selected in said selecting step.

37. A memory medium according to claim 36, wherein one of the plurality of change modes to be displayed in said displaying step comprises a change mode from a recording head, which is being used by the recording apparatus, to a recording head, which has not been used.

38. A memory medium according to claim 36, wherein one of the plurality of change modes to be displayed in the displaying step comprises a change mode from recording substance supply means, which is being used by the recording apparatus, to recording substance supply means, which has not been used.

39. A memory medium according to claim 36, wherein said displaying step is for displaying information to be recorded by the recording apparatus or information about a recording operation to be performed by the recording apparatus.

40. A memory medium according to claim 36, wherein the recording substance supply means is changeably provided for the recording head.

41. A memory medium according to claim 36, wherein said recording head is an ink jet recording head for recording characters and images on a recording medium by discharging said recording substances.

42. A memory medium according to claim 41, further comprising a discharge restoring step for restoring ink discharge from the recording head, wherein said control step is for controlling said discharge restoring step in accordance with a result of the selection performed in said selecting step.

43. A memory medium according to claim 41, wherein said recording head has discharge means using heat energy to generate bubbles in the ink so that the ink is discharged.

44. A memory medium according to claim 36, wherein said recording apparatus is an ink jet recording apparatus for recording characters and images by discharging ink supplied from said recording substance supply means, and said change control method further comprises the steps of:

detecting a quantity of ink stored in said recording substance supply means mounted on said recording apparatus; and indicating the quantity of the ink stored in said recording substance supply means, wherein said control step is for changing indications to be indicated in said indicating step in accordance with a result of the selection performed in said selecting step.

45. A program product embodying a program of a change control method for a recording apparatus having a recording head and recording substance supply means for supplying recording substances to said recording head such that at least one of said recording head and said recording substance supply means can be changed, said program for executing said change control method comprising the steps of:

displaying a plurality of change modes concerning one of change of said recording head and change of said recording substance supply means;

selecting a change mode from the plurality of change modes displayed for changing one of said recording head and said recording substance supply means; and controlling said recording apparatus in accordance with the change mode selected in said selecting step.

46. A program product according to claim 45, wherein one of the plurality of change modes to be displayed in said displaying step comprises a change mode from a recording head, which is being used by the recording apparatus, to a recording head, which has not been used.

47. A program product according to claim 45, wherein one of the plurality of change modes to be displayed in the displaying step comprises a change mode from recording substance supply means, which is being used by the recording apparatus, to recording substance supply means, which has not been used.

48. A program product according to claim 45, wherein said displaying step is for displaying information to be recorded by the recording apparatus or information about a recording operation to be performed by the recording apparatus.

49. A program product according to claim 45, wherein the recording substance supply means is changeably provided for the recording head.

50. A program product according to claim 45, wherein said recording head is an ink jet recording head for recording characters and images on a recording medium by discharging said recording substances.

51. A program product according to claim 50, further comprising a discharge restoring step for restoring ink discharge from the recording head, wherein said control step is for controlling said discharge restoring step in accordance with a result of the selection performed in said selecting step.

52. A program product according to claim 50, wherein said recording head has discharge means using heat energy to generate bubbles in the ink so that the ink is discharged.

53. A program product according to claim 45, wherein said recording apparatus is an ink jet recording apparatus for recording characters and images by discharging ink supplied from said recording substance supply means, and said change control method further comprises the steps of:

detecting a quantity of ink stored in said recording substance supply means mounted on said recording apparatus; and indicating the quantity of the ink stored in said recording substance supply means, wherein said control step is for changing indications to be indicated in said indicating step in accordance with a result of the selection performed in said selecting step.

54. A control method for an ink jet recording apparatus, said method comprising the steps of:

carrying, on a movable carriage, a recording head selected from a plurality of different types of recording heads for discharging ink to record characters and images and an ink tank selected from a plurality of different types of ink tanks for storing ink to be supplied to the recording head, the recording head and the ink tank being changeable;

providing restoring means for restoring the recording head;

determining one of the type of the recording head and the type of the ink tank; and causing the restoring means to restore the recording head in a case where one of a change of the recording head and a change of the ink tank on the movable carriage to a same type of the recording head or the ink tank has been determined in said determining step, wherein the restoring means is inhibited from restoring the recording head in a case where one of a change of the recording head and a change of the ink tank to a different type of the recording head or the ink tank has been determined in said determining step.

55. A memory medium embodying a program of a control method for an ink jet recording apparatus having a recording head, an ink tank and restoring means for restoring the recording head, said program for executing said control method comprising the steps of:

carrying, on a movable carriage, a recording head selected from a plurality of different types of recording heads for discharging ink to record characters and images and an ink tank selected from a plurality of different types of ink tanks for storing ink to be supplied to the recording head, the recording head and the ink tank being changeable;

determining one of the type of the recording head and the type of the ink tank; and causing the restoring means to restore the recording head in a case where one of a change of the recording head and a change of the ink tank on the movable carriage to a same type of the recording head or the ink tank has been determined in said determining step, wherein the restoring means is inhibited from restoring the recording head in a case where one of a change of the recording head and a change of the ink tank to a different type of the recording head or the ink tank has been determined in said determining step.

56. A program product embodying a program of a control method for an ink jet recording apparatus having a recording head, an ink tank and restoring means for restoring the recording head, said program for executing said control method comprising the steps of:

carrying, on a movable carriage, a recording head selected from a plurality of different types of recording heads for discharging ink to record characters and images and an ink tank selected from a plurality of different types of ink tanks for storing ink to be supplied to the recording head, the recording head and the ink tank being changeable;

determining one of the type of the recording head and the type of the ink tank; and causing the restoring means to restore the recording head in a case where one of a change of the recording head and a change of the ink tank on the movable carriage to a same type of the recording head or the ink tank has been determined in said determining step, wherein the restoring means is inhibited from restoring the recording head in a case where one of a change of the recording head and a change of the ink tank to a different type of the recording head or the ink tank has been determined in said determining step.

57. An electronic apparatus electrically connected to a recording apparatus having a recording head and an ink tank for supplying ink to said recording head, said electronic apparatus comprising:

a movable carriage for carrying, thereon, a recording head selected from a plurality of different types of recording heads for discharging ink to record characters and images and an ink tank selected from a plurality of different types of ink tanks for storing ink to be supplied to said recording head, said recording head and said ink tank being changeable;

restoring means for restoring said recording head;

detection means for determining one of the type of said recording head and the type of said ink tank; and control means for causing said restoring means to restore said recording head in a case where said detection means has detected one of a change of said recording head and a change of said ink tank on said movable carriage to a same type of said recording head or said ink tank, wherein said control means inhibits said restoring means from restoring said recording head in a case where said detection means has detected one of a change of said recording head and a change of said ink tank to a different type of said recording head or said ink tank.

58. An ink jet recording apparatus comprising:

a movable carriage for carrying a recording head selected from a plurality of different types of recording heads for discharging ink to record images, the recording head being changeable;

restoring means for restoring the recording head;

detection means for determining the type of the recording head; and control means for causing said restoring means to restore the recording head in a case where said detection means has detected change of the recording head on said movable carriage to a same type of recording head, wherein said control means inhibits said restoring means from restoring the recording head in a case where said detection means has detected change of the recording head to a different type of recording head.

59. An ink jet recording apparatus according to claim 58, wherein the plurality of the recording heads include monochrome recording types and color recording types.

60. An ink jet recording apparatus according to claim 58, wherein the plurality of the recording heads include large quantity ink types and small quantity ink types.

61. An ink jet recording apparatus according to claim 58, wherein said restoring means comprises a cap for covering ink discharge ports in the recording heads and a suction pump for suction from the discharge ports as an operation for restoring the recording head when said cap covers the discharge ports.

62. An ink jet recording apparatus according to claim 58, wherein the recording head comprises energy generating means for generating energy used for discharging ink.

63. An ink jet recording apparatus according to claim 62, wherein the energy generating means comprise electrothermal energy converters for generating heat energy as the discharging energy.

64. A control method of an ink jet printer, which has a movable carriage for carrying a recording head selected from a plurality of different types of recording heads for discharging ink to record images, the recording head being changeable, and restoring means for restoring the recording head, said control method comprising the steps of:

determining the type of the recording head; and controlling the restoring means to restore the recording head in a case where said determining step has detected change of the recording head on the movable carriage to a same type of recording head, and inhibiting the restoring means from restoring the recording head in a case where said determining step has detected change of the recording head to a different type of recording head.

65. An electronic apparatus to be connected to a recording apparatus, in which a recording head or recording substance supply means for supplying recording substances to the recording head is exchangeable, said electronic apparatus comprising:

display means for displaying a plurality of exchange modes for exchanging the recording head or the recording substance supply means and a remaining quantity of recording substance;

indicating means for indicating one exchange mode from the plurality of exchange modes displayed by said display means; and change means for changing the display of the remaining quantity of recording substance according to the indication from said indicating means.

66. An electronic apparatus according to claim 65, wherein said change means changes the display of the remaining quantity of recording substance in a new recording head or recording substance supply means in a case where a mode of exchanging the recording head or recording substance supply means to the new recording head or recording substance supply means is indicated, and changes the display of the remaining quantity of recording substance in a changed recording head or recording substance supply means in a case where a mode of exchanging the recording head or recording substance supply means to a different recording head or recording substance supply means is indicated.

67. An electronic apparatus according to claim 65, wherein said change means resets an accumulated recorded dots number and changes the display of the remaining quantity of recording substance in a new recording head or recording substance supply means based on the reset accumulated recorded dots number in a case where a mode of exchanging the recording head or recording substance supply means to the new recording head or recording substance supply means is indicated, and changes the display of the remaining quantity of recording substance in a changed recording head or recording substance supply means based on the accumulated recorded dots number as to the changed recording head or recording substance supply means in a case where the mode of exchanging the recording head or recording substance supply means to a different recording head or recording substance supply means is indicated.

68. An electronic apparatus according to claim 65, wherein the recording substance comprises ink.

69. A display method of an electronic apparatus to be connected to a recording apparatus, in which a recording head or recording substance supply means for supplying recording substances to the recording head can be exchanged, said display method comprising the steps of:

displaying a plurality of exchange modes for exchanging the recording head or recording substance supply means and a remaining quantity of recording substance;

indicating one exchange mode from the plurality of displayed exchange modes; and changing the display of the remaining quantity of recording substance according to the indication in said indicating step.

70. A display method of an electronic apparatus according to claim 69, wherein said changing step changes the display of the remaining quantity of recording substance in a new recording head or recording substance supply means in a case where a mode of exchanging the recording head or recording substance supply means to the new recording head or recording substance supply means is indicated, and changes the display of the remaining quantity of recording substance in a changed recording head or recording substance supply means in a case where a mode of exchanging the recording head or recording substance supply means to a different recording head or recording substance supply means is indicated.

71. A display method of an electronic apparatus according to claim 69, wherein said changing step resets an accumulated recorded dots number and changes the display of the remaining quantity of recording substance in a new recording head or recording substance supply means based on the reset accumulated recorded dots number in a case where a mode of exchanging the recording head or recording substance supply means to the new recording head or recording substance supply means is indicated, and changes the display of the remaining quantity of recording substance in a changed recording head or recording substance supply means based on the accumulated recorded dots number as to the changed recording head or recording substance supply means, in a case where a mode of exchanging the recording head or recording substance supply means to a different recording head or recording substance supply means is indicated.

72. A display method of an electronic apparatus according to claim 69, wherein the recording substance comprises ink.

73. A memory medium embodying a program of a display method of an electronic apparatus to be connected to a recording apparatus, in which a recording head or recording substance supply means for supplying recording substances to the recording head can be exchanged, said program for executing said display method comprising the steps of:

displaying a plurality of exchange modes for exchanging the recording head or recording substance supply means and a remaining quantity of recording substance;

indicating one exchanging mode from the plurality of displayed exchange modes; and changing the display of the remaining quantity of recording substance according to the indication in said indicating step.

74. A memory medium according to claim 73, wherein said changing step changes the display of the remaining quantity of recording substance in a new recording head or recording substance supply means in a case where a mode of exchanging the recording head or recording substance supply means to the new recording head or recording substance supply means is indicated, and changes the display of the remaining quantity of recording substance in a changed recording head or recording substance supply means in a case where a mode of exchanging the recording head or recording substance supply means to a different recording head or recording substance supply means is indicated.

75. A memory medium according to claim 73, wherein said changing step resets an accumulated recorded dots number and changes the display of the remaining quantity of recording substance in a new recording head of recording substance supply means based on the reset accumulated recorded dots number in a case where a mode of exchanging the recording head or recording substance supply means to the new recording head or recording substance supply means is indicated, and changes the display of the remaining quantity of recording substance in a changed recording head or recording substance supply means based on the accumulated recorded dots number as to the changed recording head or recording substance supply means, in a case where a mode of exchanging the recording head or recording substance supply means to a different recording head or recording substance supply means is indicated.

76. A memory medium according to claim 73, wherein the recording substance comprises ink.

77. A program product embodying a program of a display method of an electronic apparatus to be connected to a recording apparatus, in which a recording head or recording substance supply means for supplying recording substance to the recording head can be exchanged, said program for executing said display method comprising the steps of:

displaying a plurality of exchange modes for exchanging the recording head or recording substance supply means and a remaining quantity of recording substance;

indicating one exchange mode from the plurality of display exchange modes; and changing the display of the remaining quantity of recording substance according to the indication in said indicating step.

78. A program product according to claim 77, wherein said changing step changes the display of the remaining quantity of recording substance in a new recording head or recording substance supply means in a case where a mode of exchanging the recording head or recording substance supply means to the new recording head or recording substance supply means is indicated, and changes the display of the remaining quantity of recording substance in a changed recording head or recording substance supply means in a case where a mode of exchanging the recording head or recording substance supply means is indicated.

79. A program product according to claim 77, wherein said changing step resets an accumulated recorded dots number and changes the display of the remaining quantity of recording substance in a new recording head or recording substance supply means based on the reset accumulated recorded dots number in a case where a mode of exchanging the recording head or recording substance supply means to the new recording head or recording substance supply means is indicated, and changes the display of the remaining quantity of recording substance in a changed recording head or recording substance supply means based on the accumulated recorded dots number as to the changed recording head or recording substance supply means, in a case where a mode of exchanging the recording head or recording substance supply means to a different recording head or recording substance supply means is indicated.

80. A program product according to claim 77, wherein the recording substance comprises ink.

* * * * *

UNITED STATES PATENT AND TRADEMARK OFFICE

CERTIFICATE OF CORRECTION

PATENT NO. : 6,325,479 B1
DATED : December 4, 2001
INVENTOR(S) : Hitoshi Nakamura et al.

It is certified that error appears in the above-identified patent and that said Letters Patent is hereby corrected as shown below:

Title page,
Item [57], ABSTRACT, line 2, "hereon," should read -- thereon, --.

Column 10,
Line 22, "suction" should read -- a suction --.

Signed and Sealed this

Twenty-third Day of April, 2002

*Attest:*

*Attesting Officer*

JAMES E. ROGAN
*Director of the United States Patent and Trademark Office*